US012595967B2

(12) United States Patent
Uribe et al.

(10) Patent No.: US 12,595,967 B2
(45) Date of Patent: Apr. 7, 2026

(54) HEAT EXCHANGE APPARATUS, SYSTEM, AND METHOD

(71) Applicant: Baltimore Aircoil Company, Inc., Jessup, MD (US)

(72) Inventors: Carlos Uribe, Baltimore, MD (US); Richard David Wall, III, Woodbine, MD (US); Corey Goldfein, College Park, MD (US); Thomas Van Dijck, Lier (BE)

(73) Assignee: Baltimore Aircoil Company, Inc., Jessup, MD (US)

( * ) Notice: Subject to any disclaimer, the term of this patent is extended or adjusted under 35 U.S.C. 154(b) by 678 days.

(21) Appl. No.: 17/837,679

(22) Filed: Jun. 10, 2022

(65) Prior Publication Data

US 2023/0400255 A1 Dec. 14, 2023

(51) Int. Cl.
*F28C 1/14* (2006.01)
*F28D 1/02* (2006.01)

(52) U.S. Cl.
CPC ..... *F28C 1/14* (2013.01); *F28D 1/024* (2013.01); *F28C 2001/145* (2013.01)

(58) Field of Classification Search
CPC ..... F28C 1/14; F28C 2001/145; F28D 1/024
See application file for complete search history.

(56) References Cited

U.S. PATENT DOCUMENTS 3,998,394 A 12/1976 Ovard
4,637,225 A 1/1987 Marshall
5,180,528 A 1/1993 Kaplan
(Continued)

FOREIGN PATENT DOCUMENTS

CA 2808810 9/2013
EP 1698847 9/2006
(Continued)

OTHER PUBLICATIONS

3C Condenser Heat Rejection Systems—SH09 Series Microchannel, Installation, Operation & Maintenance Manual; Muller Industries; publicly available before Jan. 20, 2014; 30 pages.
(Continued)

*Primary Examiner* — Jerry-Daryl Fletcher
*Assistant Examiner* — Keith Stanley Myers
(74) *Attorney, Agent, or Firm* — Fitch, Even, Tabin & Flannery LLP

(57) ABSTRACT

A heat exchange apparatus is disclosed having a liquid distribution system configured to distribute liquid onto a liquid absorbent material and an airflow generator operable to cause air to flow through the liquid absorbent material and toward an indirect heat exchanger. The heat exchange apparatus includes a controller configured to operate in a dry mode where the controller inhibits the liquid distribution system from distributing liquid onto the liquid absorbent material and a wet mode where the controller causes the liquid distribution system to distribute liquid onto the liquid absorbent material. The controller is further configured to operate at least one of the liquid distribution system and the airflow generator to inhibit drift of liquid from the liquid absorbent material toward the indirect heat exchanger in response to the controller switching from the dry mode to the wet mode.

47 Claims, 11 Drawing Sheets

(56) References Cited

U.S. PATENT DOCUMENTS

| | | | |
|---|---|---|---|
| 5,226,285 | A | 7/1993 | Dankowski |
| 5,273,687 | A | 12/1993 | Osborne |
| 5,435,382 | A | 7/1995 | Carter |
| 5,724,828 | A | 3/1998 | Korenic |
| 5,816,318 | A | 10/1998 | Carter |
| 6,047,555 | A | 4/2000 | Weng |
| 6,142,219 | A | 11/2000 | Korenic |
| 6,213,200 | B1 | 4/2001 | Carter |
| 6,427,461 | B1 | 8/2002 | Whinery |
| 6,574,980 | B1 | 6/2003 | Morrison |
| 7,310,958 | B2 | 12/2007 | Carter |
| 7,484,718 | B2 | 2/2009 | Facius |
| 7,603,774 | B2 | 10/2009 | Facius |
| 8,483,883 | B1 | 7/2013 | Watson |
| 8,676,385 | B2 | 3/2014 | Myers |
| 9,057,563 | B2 | 6/2015 | Carter |
| 9,057,564 | B2 | 6/2015 | Carter |
| 9,279,619 | B2 | 3/2016 | Aaron |
| 9,995,533 | B2 | 6/2018 | Aaron |
| 10,132,577 | B2 | 11/2018 | Martell |
| 10,415,902 | B2 | 9/2019 | Shin |
| 10,619,953 | B2 | 4/2020 | Blay |
| 11,029,093 | B2 | 6/2021 | Shin |
| 11,092,394 | B2 | 8/2021 | Blay |
| 11,150,037 | B2 | 10/2021 | Egolf |
| 11,287,191 | B2 | 3/2022 | Aaron |
| 2004/0196631 | A1 | 10/2004 | Ueda et al. |
| 2005/0012230 | A1 | 1/2005 | Kammerzell |
| 2007/0101746 | A1 | 5/2007 | Schlom |
| 2007/0187851 | A1 | 8/2007 | Facius |
| 2008/0018001 | A1 | 1/2008 | Kammerzell |
| 2008/0115921 | A1 | 5/2008 | Hall |
| 2010/0154448 | A1 | 6/2010 | Hay |
| 2010/0162737 | A1 | 7/2010 | Hall |
| 2010/0281896 | A1 | 11/2010 | Al Watban |
| 2010/0315770 | A1 | 12/2010 | Tipley |
| 2011/0100593 | A1 | 5/2011 | Benz |
| 2011/0168354 | A1 | 7/2011 | De Jong |
| 2011/0168362 | A1 | 7/2011 | Hall |
| 2011/0289951 | A1 | 12/2011 | Furlong |
| 2012/0067546 | A1 | 3/2012 | Bugler, III |
| 2015/0204626 | A1* | 7/2015 | Martell ..... F28C 1/14 165/200 |
| 2018/0224174 | A1 | 8/2018 | Hollander |
| 2018/0283814 | A1* | 10/2018 | Najafifard ..... F28B 1/02 |
| 2020/0208887 | A1* | 7/2020 | Mohammad ..... F25B 39/04 |
| 2020/0300553 | A1* | 9/2020 | Aaron ..... F28F 27/003 |
| 2021/0356221 | A1 | 11/2021 | Blay |
| 2022/0163263 | A1 | 5/2022 | Blay |
| 2022/0196330 | A1 | 6/2022 | Guy |

FOREIGN PATENT DOCUMENTS

| | | |
|---|---|---|
| JP | 2007285620 | 11/2007 |
| WO | 2005005905 | 1/2005 |
| WO | 2007015281 | 2/2007 |
| WO | 2010037164 | 4/2010 |
| WO | 2015059038 | 4/2015 |

OTHER PUBLICATIONS

TrilliumSeries™ Condenser—Rigging, Operation & Maintenance Manual; Baltimore Aircoil Company; M450/I-E; 2013; 20 pages.
TrilliumSeries™ Condenser; brochure from Baltimore Aircoil Company; S410/1-C; 2013; 12 pages.
U.S. Appl. No. 62/062,539, filed Oct. 14, 2014; 31 pages.
U.S. Appl. No. 62/456,873, filed Feb. 9, 2017; 27 pages.
U.S. Appl. No. 63/023,467, filed May 12, 2020; 47 pages.
U.S. Appl. No. 63/394,687, filed Aug. 3, 2022; 115 pages.

* cited by examiner

HEAT EXCHANGE APPARATUS, SYSTEM, AND METHOD

FIELD

This disclosure relates to heat exchange systems and, more specifically, to control systems for heat exchange systems.

BACKGROUND

Some indirect heat exchangers operate by transmitting hot fluid through a conduit and passing cool air over that conduit. For example, a heat exchanger may include a fluid-receiving coil positioned in an air flow path. As the air passes over the coil, heat is indirectly exchanged between the fluid and the air via the coil.

To increase the efficiency of the indirect heat exchange process, some heat exchangers utilize adiabatic cooling systems that dispense evaporative liquid, such as water, over an adiabatic pad. The adiabatic pad is positioned in the flow path of the air upstream of the coil. The liquid in the adiabatic pad evaporates into the air passing through the pad which lowers the temperature of the air before the air passes over the coil. The cooler air passing over the coil improves the efficiency of the indirect heat exchange process.

One shortcoming of some existing heat exchangers is that when the heat exchanger begins dispensing the evaporative liquid onto the adiabatic pad, the flow of air through the adiabatic pad strips liquid particles from the adiabatic pad and carries the liquid particles from the adiabatic pad and onto the heat exchanger coil. The liquid particles removed from the adiabatic pad, referred to herein as drift, may be undesirable due to the scale and mineral deposits left behind on the coil as the liquid evaporates. The scale and mineral deposit buildup may reduce the efficiency of the heat exchange and may restrict or even block the flow of air through the coil. Thus, the lifespan of the heat exchanger may be reduced and/or the heat exchanger may require maintenance to remove the scale and mineral buildup resulting in downtime for the heat exchanger.

DETAILED DESCRIPTION

Figure 1:
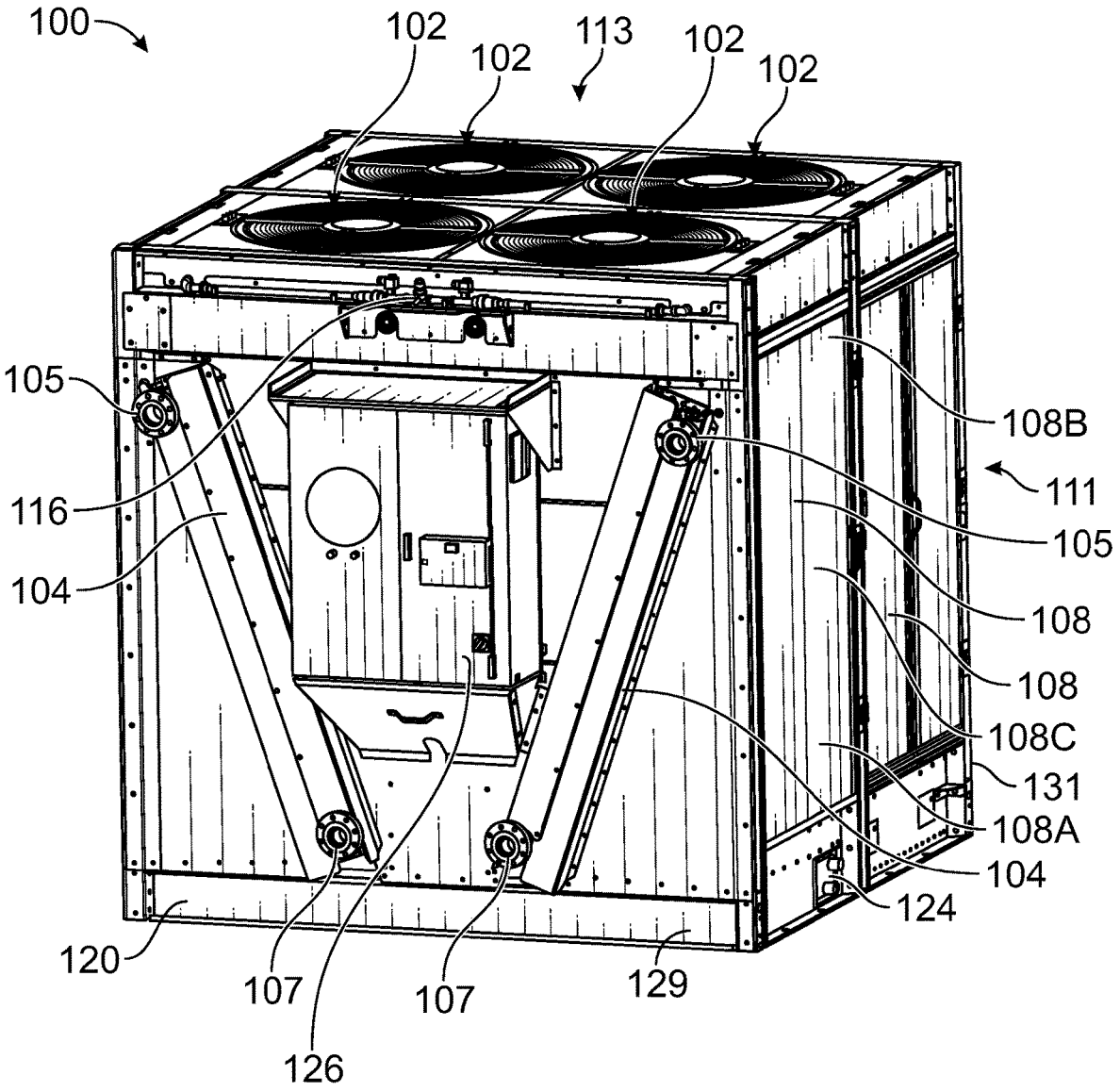
FIG. 1 is a top perspective view of a cooling tower having indirect heat exchangers, fans, and adiabatic pads in accordance with an embodiment of the present disclosure.

A heat exchange apparatus, such as a cooling tower, is provided having a heat exchanger, a liquid absorbent material, a liquid distribution system to distribute liquid onto the liquid absorbent material, and an airflow generator operable to generate airflow from the liquid absorbent material to the heat exchanger. The heat exchanger transfers heat between a working fluid and air moving relative to the heat exchanger. The heat exchanger may include a direct heat exchanger and/or an indirect heat exchanger. The direct heat exchanger may include, for example, fill and the indirect heat exchanger may include, for example, a coil (e.g., a serpentine coil or microchannel-coil) and/or a plate. The heat exchange apparatus has a controller that operates at least one of the liquid distribution system and the airflow generator to inhibit drift of liquid from the liquid absorbent material onto the heat exchanger.

In one embodiment, the controller has dry and wet modes of operation. In the dry mode, the controller inhibits the liquid distribution system of the heat exchange apparatus from dispensing liquid onto the liquid absorbent material. In the wet mode, the controller causes the liquid distribution system to distribute liquid onto the liquid absorbent material. The controller limits liquid drift from the liquid absorbent material onto the heat exchanger, for example, by setting a limit on an operational parameter of the heat exchange apparatus as the controller changes from a dry mode of operation to a wet mode of operation.

In one embodiment, the airflow generator includes a fan and the controller operates the fan to inhibit drift of liquid from the liquid absorbent material onto the heat exchanger. For example, the airflow generator may include a fan and the controller may set a maximum operational speed of the fan as the liquid absorbent material is being wetted. Thus, the controller will temporarily limit the operational speed of the fan, such as 50% of the maximum speed of the fan, even if the controller determines a fan speed higher than the set maximum operational speed is required to achieve a return fluid temperature requested by a heating ventilation air conditioning (HVAC) controller of a building. The set maximum operational speed of the fan provides an upper limit on the airflow velocity through the liquid absorbent material, which may reduce the number of liquid droplets in the airflow as the airflow exits the liquid absorbent material. Further, the maximum operational speed of the fan establishes an upper limit on the velocity of liquid droplets in the airflow and permits the liquid droplets in the airflow to fall into a liquid collector of the heat exchange apparatus under the effect of gravity. The maximum operational speed of the fan protects the heat exchanger from damage caused by drift from the liquid absorbent material until the liquid absorbent material is adequately saturated as discussed in greater detail below. Further, the controller may adjust the maximum operational speed of the fan as the liquid absorbent material is being wetted based on, for example, time and/or the amount of liquid absorbed by the liquid absorbent material.

Once the liquid absorbent material is sufficiently wetted, the controller sets the maximum operational speed of the fan to a higher speed, e.g., 100% of the maximum speed of the fan. The controller is thereby able to operate the fan throughout the full range of speeds of the fan (e.g., 0% to 100% of the maximum fan speed) as needed to achieve the return fluid temperature requested by the HVAC system controller. In one embodiment, the maximum operational speed of the fan once the liquid absorbent material is sufficiently wetted is the maximum speed of the fan set by the fan's manufacturer.

Liquid traveling along the sufficiently wetted liquid absorbent material is kept on the liquid absorbent material by, for example, surface tension of the liquid and the capillary action of the liquid in the adhesive material. Thus, the liquid on the liquid absorbent material is less able to leave the liquid absorbent material as drift once the liquid absorbent material is sufficiently wetted. The fan may therefore be operated at 100% of the maximum speed of the fan if needed without generating undesirable drift.

In another embodiment, the controller operates the liquid distribution system to limit drift from the liquid absorbent material onto the heat exchanger. For example, the controller may set a maximum liquid distribution rate of the liquid onto the liquid absorbent material until the liquid absorbent material is sufficiently wetted.

In one embodiment, the heat exchange apparatus includes a drift sensor operatively connected to the controller. Upon the sensor detecting liquid droplets in the airflow traveling toward the heat exchanger, the controller adjusts the operation of the airflow generator and/or liquid distribution system to reduce the drift from the liquid absorbent material.

With respect to FIGS. 1-5, a cooling tower 100 is disclosed that limits drift within the cooling tower 100. While a cooling tower is provided by way of example herein, the concepts disclosed in the following discussion may similarly be used in other heat exchange systems that utilize adiabatic cooling and/or adiabatic pads, such as, for example, swamp coolers, building humidification systems, air handlers, and various applications such as, for example, heat exchanger systems for hospitals, greenhouses, and/or livestock. The cooling tower 100 has an airflow generator, such as fan assemblies 102, a heat exchanger such as one or more indirect heat exchangers 104, a liquid distribution system 106, and a liquid absorbent material, such as one or more adiabatic pads 108.

Figure 2:
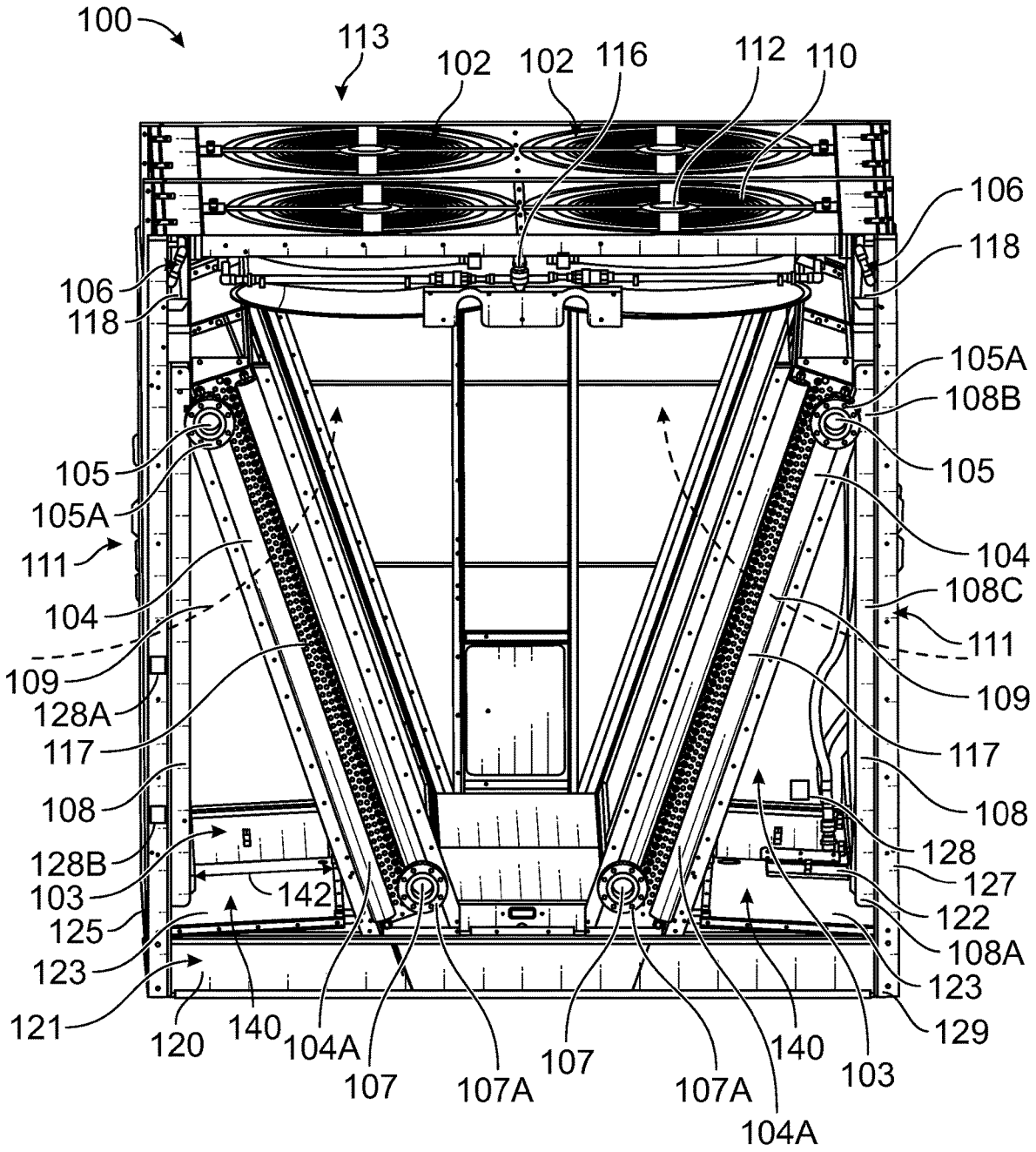
FIG. 2 is a side cutaway view of the cooling tower of FIG. 1 showing the indirect heat exchangers and the adiabatic pads.

With respect to FIG. 2, the fan assembly 102 includes one or more fans 110 and motors 112 that rotate the fans 110 to generate airflow along path 109 relative to a housing 101 of the cooling tower 100. Specifically, the fan assembly 102 draws air into air inlets 111 of the housing 101, through the adiabatic pads 108, and from the adiabatic pads 108 to the indirect heat exchangers 104. The air flows from the adiabatic pads 108 into plenums 103 between the adiabatic pads 108 and the indirect heat exchangers 104. The adiabatic pads 108 may be made from any liquid absorbing material that permits air to flow therethrough including, as an example, cellulose and/or impregnated cellulose fiber. As another example, the liquid absorbing material may include an inorganically impregnated glass fiber.

The indirect heat exchangers 104 each include an inlet header 105A for receiving a fluid, an outlet header 107A, and a coil 117 connecting the inlet and outlet headers 105A, 107A. The coil 117 has a plurality of runs intermediate the inlet and outlet headers 105A, 107A. In one embodiment, the coil 117 includes one or more tubes each having an interior that permits fluid to travel therethrough and a sidewall extending about the interior. The coil 117 may have a number of configurations, such as pairs of straight runs connected by U-bends. In another embodiment, the coil 117 includes serpentine tubes. The coil 117 may or may not include fins.

Figure 14:
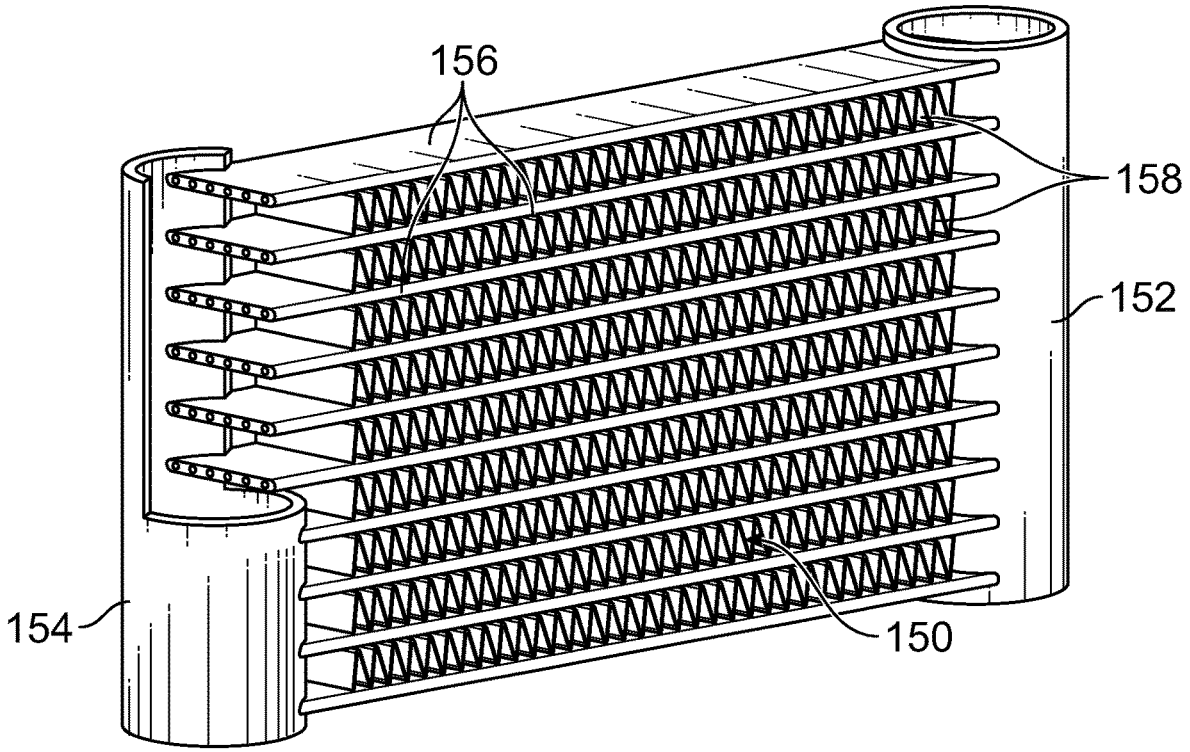
FIG. 14 is a partial cutaway view of a microchannel coil of the indirect heat exchanger of the cooling tower of FIG. 1 according to one embodiment.

With respect to FIG. 14, in some embodiments, the indirect heat exchangers 104 include a microchannel coil 150 extending between an inlet header 152 and an outlet header 154. The microchannel coil 150 includes one or more flat tubes 156 extending from the inlet header 152 to the outlet header 154. Each tube 156 includes a plurality of channels through which the fluid flows from the inlet header 152 to the outlet header 154. The microchannel coil 150 may include one or more tubes 156 having straight runs connected by U-shaped bends. For example, a single tube 156 may be formed into a coil formed of straight runs connected by U-shaped bends with a first end connected to the inlet header 152 and a second end connected to the outlet header 154. The microchannel coil 150 may include fins 158 extending between the tubes 156 (or between straight runs of the same tube) to facilitate heat transfer from the fluid in the tubes 156 into the air passing through the microchannel coil 150. The fins 158 may be formed of one or more corrugated metal sheets (e.g., aluminum) positioned between the tubes 156.

The fluid received at the inlet header 105A may include, for example, liquid water, water vapor (e.g. steam), a mixture of liquid water and water vapor, ammonia, brine, and/or a glycol (e.g., propylene, ethylene). In one embodiment, the fluid may include a refrigerant such as R-134a, R410, R404, and/or R744. The inlet header 105A has a fluid inlet 105 and the outlet header 107A a fluid outlet 107. The fluid enters the inlet header 105A at fluid inlet 105, travels through the coil 117, and is collected at outlet header 107A before flowing out of the indirect heat exchanger 104 via the fluid outlet 107.

The rotation of the fans 110 causes air to move from the air inlet 111, through the adiabatic pads 108, into plenum spaces 103, across the coils 117 of the indirect heat exchangers 104, upward through the fan assemblies 102, and out of an air outlet 113 of the cooling tower 102. In one approach, the fluid in the coil 117 has a higher temperature than the air flowing over the coil 117 such that heat transfers through the tube sidewalls of the coil 117 from the higher temperature fluid in the interior of the coil 117 to the cooler airflow moving over the exterior of the coil 117.

Figure 3:
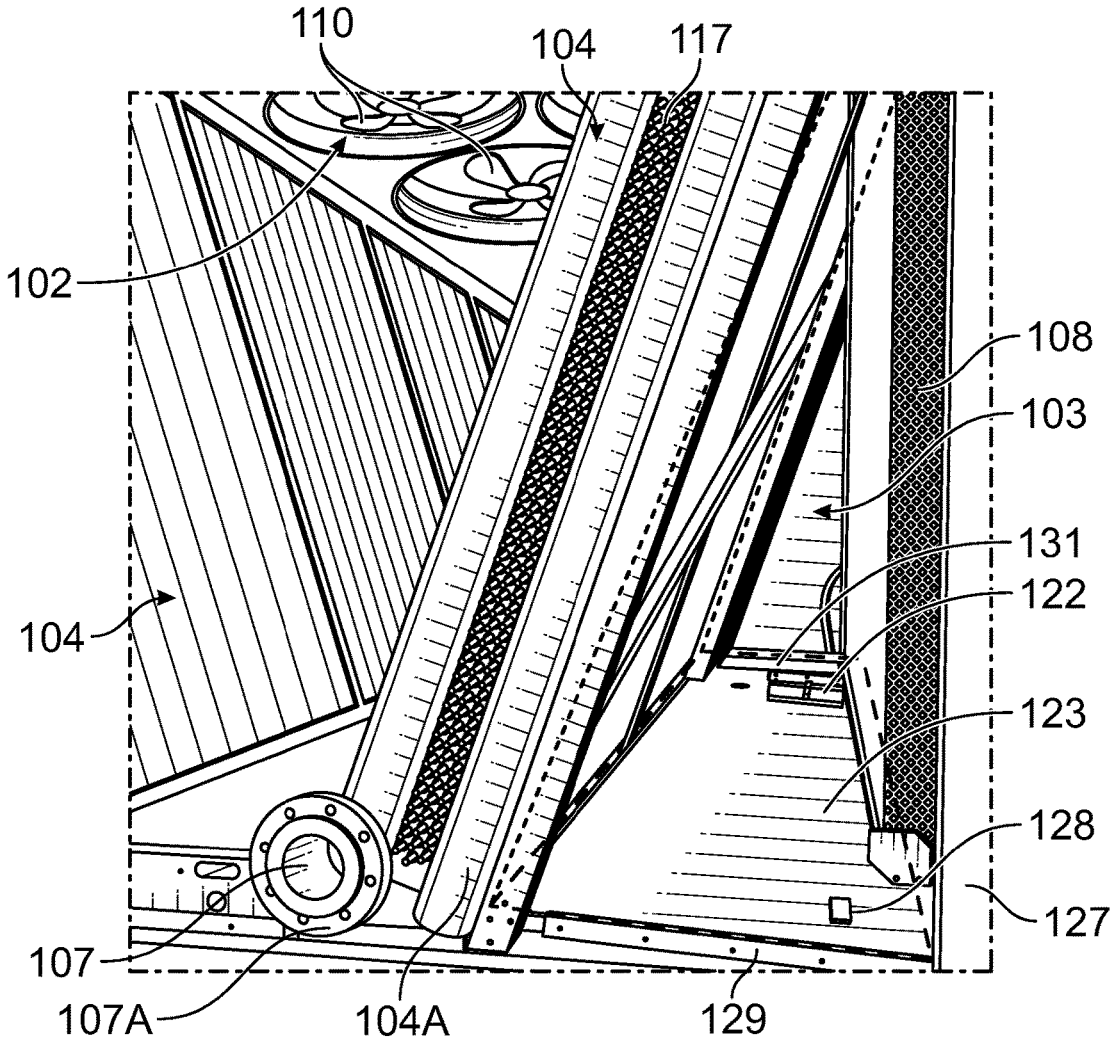
FIG. 3 is a close-up view of a portion of an indirect heat exchanger and an adiabatic pad of the cooling tower of FIG. 1.
Figure 4:
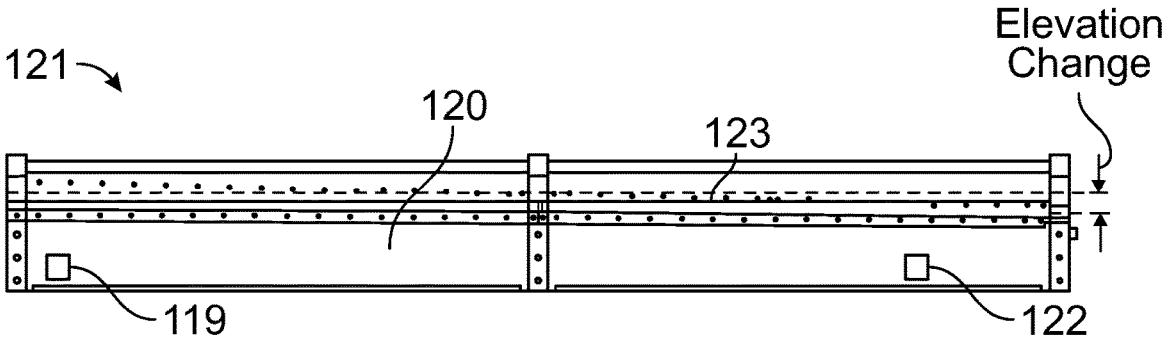
FIG. 4 is a cross-sectional view of a fluid collection basin of the cooling tower of FIG. 1.

The liquid distribution system 106 includes a liquid supply valve connected to a liquid supply. The liquid utilized by the liquid distribution system 106 may be, for example, water (e.g., tap water, rain water, and/or non-potable water). In some embodiments, the liquid distribution system receives water from a water treatment system that converts raw water into processed water having properties and/or additives (e.g., anti-fungal, anti-microbial) suitable for distribution in the cooling tower 100. In one embodiment, the liquid supply valve includes a makeup valve 116, that may be opened to distribute liquid into one or more troughs 118 of the cooling tower 100. The makeup valve 116 may be opened to dispense liquid into the troughs 118 when the sump 120 is empty, when the liquid level in the sump 120 is low, and/or to introduce fresh liquid into the cooling tower 100. The trough 118 includes one or more outlets, such as holes, through which the liquid in the trough 118 may be dispensed onto the adiabatic pads 108 by the liquid distribution system 106. The troughs 118 may extend along the length (into the page in FIG. 2) of the adiabatic pads 108 and distribute liquid substantially evenly across the pads 108. Liquid that is not absorbed by the adiabatic pads 108 may fall to a fluid collection basin 121 that includes a sump 120 positioned below the adiabatic pads 108. As shown in FIGS. 2-4, the fluid collection basin 121 includes fluid collection trays 123 that receive the falling liquid. The fluid collection trays 123 are sloped to direct the fluid into the sump 120 of the fluid collection basin 121. For instance, the height of the fluid collection trays 123 are lower at sidewalls 125, 127 of the housing 101 than at the indirect heat exchanger 104 to direct liquid away from the indirect heat exchanger 104. The fluid collection trays 123 may, for example, have a one to two degree slope from the horizontal. As shown in FIG. 4, the fluid collection trays 123 also may slope downward as they extend from the front 129 to the rear 130 of the cooling tower 100 (or vice versa) such that the liquid on the tray 123 is directed toward a corner of the tray 123. The fluid collection trays 123 may direct the fluid to openings in the trays 123 through which the fluid passes into the sump 120.

With respect to FIGS. 1 and 2, the liquid distribution system 106 further includes a pump 122 within the sump 120. In one embodiment, the pump 122 includes multiple pumps 122. The pump 122 pumps liquid from the sump 120 to the troughs 118 and may be operated to dispense the liquid into the troughs 118 when there is water in the sump 120. The pump 122 thereby recirculates the liquid within the cooling tower 100 which may reduce the amount of liquid consumed by the cooling tower 100. The sump 120 may have a drain valve 124 that may be opened to drain fluid from the sump 120 and out of circulation within the cooling tower 100. The sump 120 may have one or more floats 119 or other sensor that monitors the amount of liquid in the sump 120. The drain valve 124 may be opened to drain liquid from the sump 120, for example, when there is too much liquid in the sump 120 or to completely drain the liquid from the sump 120 as part of a liquid changeover process.

The cooling tower 100 may include one or more sensors 128 to monitor one or more variables of the cooling tower 100. The sensor 128 may include, for example, a temperature sensor, a humidity sensor, a water sensor, and/or a weight sensor. The one or more sensors 128 may include one or more sensors inside of the housing 101 and one or more sensors outside of the housing 101. For example, a sensor 128 may be mounted in the plenum 103 between the adiabatic pad 108 and the indirect heat exchanger 104 to monitor the temperature and/or humidity of the air that has passed through the adiabatic pad 108. The sensor 128 may measure the wet bulb and/or dry bulb temperature of the air. A sensor 128 may also be mounted outside of the cooling tower 100 and upstream of the adiabatic pad 108 to monitor the temperature and/or humidity of the air before the air passes through the adiabatic pad 108. In some forms, one or more sensors 128 may be embedded within the adiabatic pad 108 to detect the presence of water within the pad 108 at the sensor 128. For example, water sensors may be embedded at various heights of the pad 108 to monitor which portions of the pad 108 have absorbed liquid distributed from the liquid distribution system 106. For instance, a water sensor may be mounted at the lower end of the pad 108 where the liquid is distributed to the top of the pad 108 to detect when liquid has reached the lower portion of the pad 108 (e.g., indicating the pad 108 is soaked/nearly soaked). Water sensors may also be mounted on various components within the cooling tower 100 to monitor liquid drift within the cooling tower 100. For example, one or more water sensors may be mounted on the indirect heat exchanger 104 or on the fluid collection tray 123 to detect when liquid particles are drifting from the pad 108. As another example, one or more laser sensors may be mounted within the cooling tower to detect liquid particles in the air drifting from the pad 108 toward the indirect heat exchanger 104.

Figure 5:
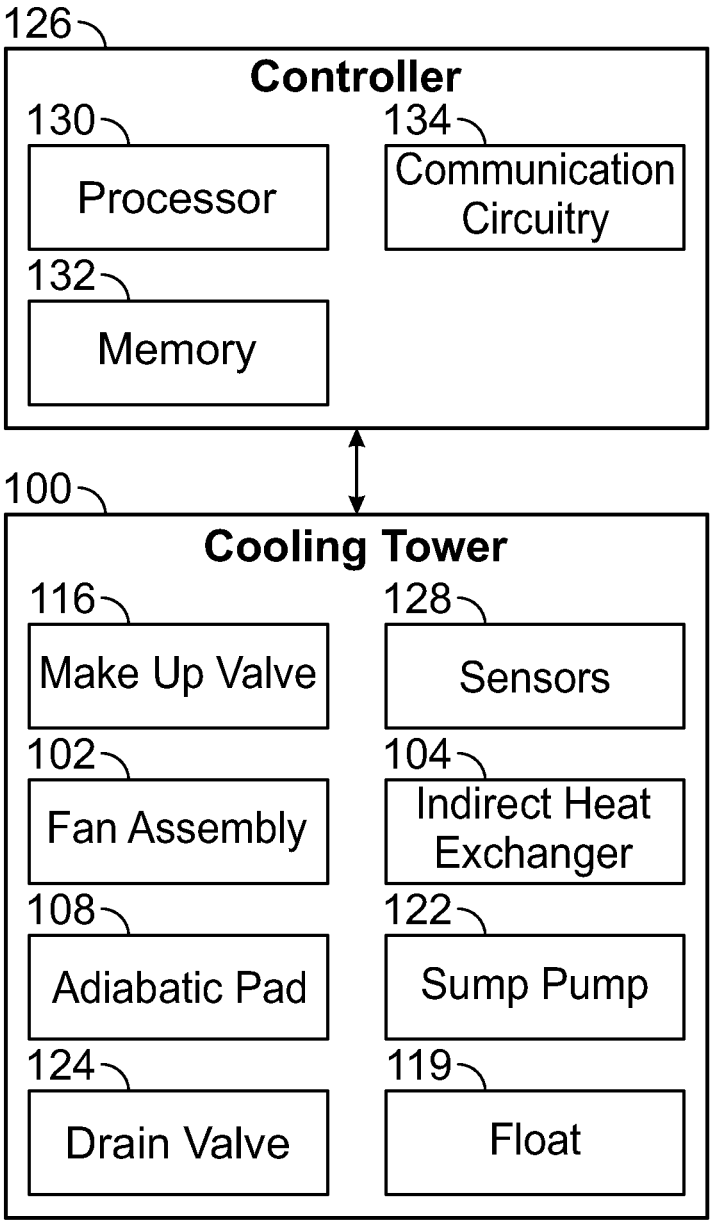
FIG. 5 is an example block diagram of the cooling tower of FIG. 1.

With respect to FIG. 5, the cooling tower 100 is associated with a controller 126 that is connected to and controls the operation of the fan assembly 102 and liquid distribution system 106. The controller 126 includes a processor 130, memory 132, and communication circuitry 134. The processor 130 communicates with the memory 132 to provide functionality to the cooling tower 100. The processor 130 may be configured to provide information processing capabilities and may include a plurality of processing units in communication with one another. The processor 130 may include, as examples, one or more of a digital processor, an analog processor, a PID controller, a microprocessor, a microcontroller, application-specific integrated circuit (ASIC), and a system-on-a-chip. The memory 132 may store logic, instructions, and operating parameters accessible to the processor 130 for operating the cooling tower 100. The memory 132 may include, as examples, one or more of RAM, DRAM, SDRAM, EEPROM, ROM, and FLASH. The communication circuitry 134 may include, as examples, one or more of an ethernet interface, a Wi-Fi network interface, and Bluetooth interface. The processor 130 may receive data from the sensors 128 of the cooling tower to monitor the operation of the cooling tower 100. The processor 130 may receive control signals from, and communicates data with, a remote computer such as a HVAC system controller of a building of the cooling tower 100 via the communication circuitry. As another example, the processor 130 may communicate with a remote device such as a server computer and/or a portable electronic device of a technician such as a smartphone, tablet computer, or laptop computer.

For example, the processor 130 may receive a control signal including a set point temperature for the fluid exiting the outlets 107 of the indirect heat exchanger 104. The processor 130 may determine operating parameters for the cooling tower 100 to meet the set point temperature. For example, the processor 130 may control the speed of the fan assemblies 102, whether the pump 122 is on/off, and whether the makeup valve 116 is open or closed. The processor 130 may communicate control signals to the fan assembly 102 and/or the liquid distribution system 106 to meet the set point temperature. The processor 130 may communicate the control signals to the fan assembly 102 and/or the liquid distribution system 106 via the communication circuitry 134. The controller 126 may be connected to multiple cooling towers 100 and configured to operate each cooling tower 100 to meet the cooling demands of the building. The communication circuitry 134 may be configured to communicate via wired and/or wireless communication protocols, such as Ethernet, Wi-Fi, Bluetooth, cellular and the like.

The controller 116 operates the fan assemblies 102 to generate airflow through the cooling tower 100. The controller 126 may operate the fan assembly 102 to draw air through the adiabatic pads 108 and across the indirect heat exchangers 104 to cool the fluid flowing within the coils 117. The controller 100 may also operate the liquid distribution system 106 control the distribution of liquid onto the adiabatic pads 108. The controller 116 is thus able to operate the cooling tower 100 in a dry mode where the controller 116 inhibits the liquid distribution system 106 from distributing liquid on the adiabatic pads 108 and in a wet mode where the controller 116 causes the liquid distribution systems 106 to distribute liquid onto the adiabatic pads 108.

Depending on operating conditions, the cooling tower 100 may have increased cooling capacity when operated in the wet mode. When the adiabatic pads 108 are soaked or saturated with the liquid from the liquid distribution systems 106, the temperature of the air flowing through the adiabatic pads 108 is reduced as the liquid evaporates into the air. The cooled air then flows over the indirect heat exchangers 104. Because the temperature of the air is reduced as it flows through the soaked adiabatic pads 108, the air is able to remove more heat from the fluid passing through the coils 117 of the indirect heat exchangers 104. The controller 126 may operate the cooling tower 100 in a wet mode to meet a specified cooling demand (e.g., such that the fluid exiting the outlets 107 of the indirect heat exchangers 104 is at a certain temperature or pressure) that, for example, the cooling tower 100 is not able to meet when operating in the dry mode. The controller 126 may also operate the cooling tower 100 in the wet mode to meet a specified cooling demand while reducing the speed of the fan assemblies 102. Reducing the speed of the fan assemblies 102 may reduce the amount of electricity used to operate the fan assemblies 102 which may lower the operational cost of the cooling tower 100 (e.g., at times of peak energy usage/cost).

The controller 126 may be configured to operate the cooling tower 100 (e.g., the fan assembly 102 and/or liquid distribution system 106) to inhibit drift of liquid from the adiabatic pad 108 toward the indirect heat exchanger 104. Liquid that drifts from the adiabatic pad 108 and contacts the hot indirect heat exchangers 104 may evaporate from surfaces of the indirect heat exchangers 104 leaving behind scale or mineral deposits on the indirect heat exchanger 104. The scale buildup on the indirect heat exchangers 104 is undesirable as it may reduce the efficiency of the heat transfer from the indirect heat exchanger 104 to the air, restricts the airflow through the coil 117, and may reduce the lifespan of the indirect heat exchangers 104. Liquid drift is prone to occur as the adiabatic pad 108 has not yet been soaked or saturated with liquid as the cooling tower 100 switches from the dry mode to the wet mode. When the adiabatic pad 108 is initially being soaked and a liquid saturation level of the adiabatic pad 108 is low, liquid is prone to being drawn from the adiabatic pad 108 by the airflow generated by the fan assembly 102 toward the indirect heat exchanger 104. As the saturation level of the adiabatic pad 108 increases, the liquid is progressively less prone to being stripped from or drawn out of the adiabatic pad 108, e.g., due to the strong adhesion and cohesion properties of water within the adiabatic pad 108 keeping the water within the adiabatic pad 108. By limiting or inhibiting the amount of liquid drift, the scale buildup on the indirect heat exchanger 104 is mitigated which may result in increased uptime, reduced maintenance, and a longer lifespan for the indirect heat exchanger 104 and/or cooling tower 100.

Additionally, many current heat exchanger coils are coated to prevent corrosion from liquid drift. By inhibiting liquid drift, uncoated heat exchanger coils 117 may be used which may increase the heat transfer efficiency of the coils 117 of the indirect heat exchanger 14 and/or cooling tower 100. Further, uncoated heat exchanger coils 117 may be less expensive than corresponding coated heat exchanger coils because the coating process is avoided. Specifically, the coating process typically utilizes electrodeposition to provide an anticorrosion coating on the metal of the heat exchanger coils 117. The uncoated heat exchanger coils 117 may be, for example, stainless steel or copper with aluminum fins.

In some forms, upon the controller 126 switching the operation of the cooling tower 100 from the dry mode to the wet mode, the controller 126 operates the cooling tower 100 in a transition phase. In the transition phase, the controller 126 may limit an operational parameter of the cooling tower 100 as the adiabatic pad 108 is being soaked to inhibit the drift from the adiabatic pad 108 before transitioning to an operation phase where the operational parameter is no longer limited. In some forms, the controller 126 adjusts the operation of the cooling tower 100 based on data received from sensors 128 indicative of the amount of drift within the cooling tower 100. The controller 126 may adjust the operation of the cooling tower 100 to inhibit or limit drift from occurring. Where some liquid drift is acceptable, the controller 126 operates the cooling tower 100 such that the liquid drift is within the acceptable range. For example, in cooling towers 100 where the indirect heat exchangers 104 slope away from the adiabatic pads 108 such there are gaps 140 between lower portions 104A of the indirect heat exchangers 104 and lower portions 108A of the adiabatic pad 108 (e.g., as shown in FIG. 2) having a distance 142 that decreases as the indirect heat exchanges 104 extend upward toward the adiabatic pads 108. The controller 126 may permit some liquid drift to fall into the gaps between the indirect heat exchanger 104 and the pad 108 and onto the fluid collection tray 123 but inhibit liquid drift from reaching the indirect heat exchanger 104. Operating the cooling tower 100 to inhibit liquid drift may also allow the minimize the horizontal distance between the indirect heat exchangers 104 and the adiabatic pads 108. For example, the indirect heat exchangers 104 may extend substantially parallel to the adiabatic pads 108 rather than being inclined relative to the adiabatic pads 108. Such a configuration may be advantageous as the overall size of the cooling tower 100 may be reduced as the size of the gap is reduced.

Figure 6:
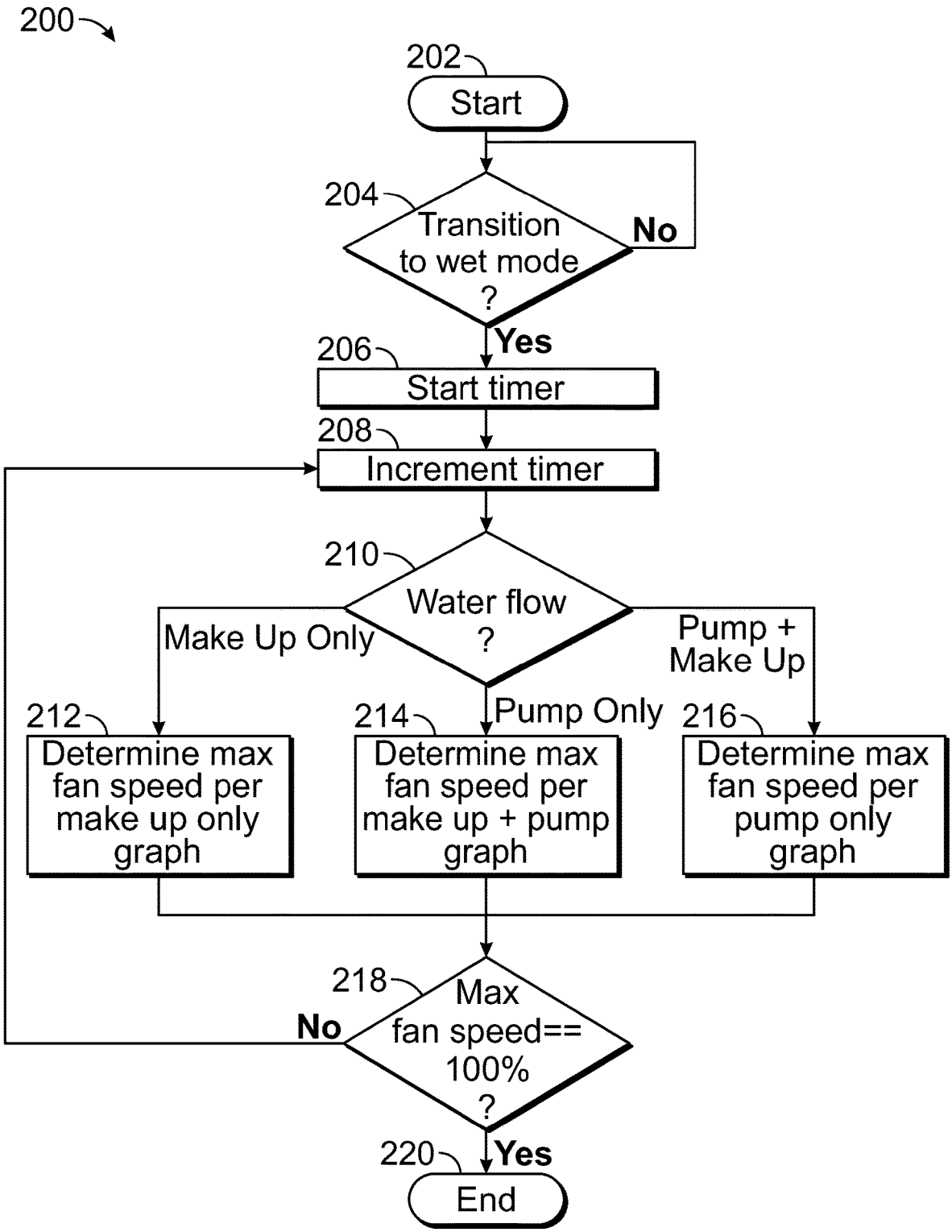
FIG. 6 is a flow chart of an example method of operating the cooling tower of FIG. 1 to transition to a wet mode.

With reference to FIG. 6, a method 200 is provided for operating the cooling tower 100 to inhibit drift from the adiabatic pads 108 based on the time since the cooling tower 100 transitioned from the dry mode of operation to the wet mode of operation. The method 200 begins 202 with the controller 126 operating the cooling tower 100 in the dry mode. The controller 126 may determine 204 whether to transition to the wet mode. The controller 126 may be configured to always begin operation in the dry mode and then evaluate whether to transition into the wet mode. The controller 126 may determine whether to transition to the wet mode as discussed above, for example, to meet the cooling demand/set point and/or to reduce the operational costs of the cooling tower 100 (e.g., optimized based on current electric and water costs). As another example, the determining 204 may include the controller 126 determining whether the controller 126 has received a command to operate in the wet mode from a remote computer such as an HVAC system controller. Where the controller 126 determines to continue in the dry mode, the controller 126 returns to step 204 until the controller 126 determines 204 to transition to the wet mode.

If the controller 126 determines 204 to transition to the wet mode, the controller 126 starts 206 a timer. The controller 126 increments 208 the timer and determines 210 how the liquid distribution system 106 is distributing liquid to the adiabatic pads 108. For example, the controller 126 determines whether the liquid distribution system 106 is dispensing liquid via the makeup valve 116, by operating the pump 122, or both. In some forms, the controller 126 sends control signals (e.g., via the communication circuitry 134) to the liquid distribution system 106 instructing the liquid distribution system 106 (or directly controls the individual components thereof) to dispense liquid via the makeup valve 116, by operating the pump 122, or both and may determine 210 how the liquid distribution system 106 is distributing liquid by reviewing the current or most recent control signals sent to the liquid distribution system 106. In some forms, the controller 126 receives data from sensors indicating whether the pump 122 is operating and/or whether the makeup valve 116 is open and dispensing liquid.

Figure 7:
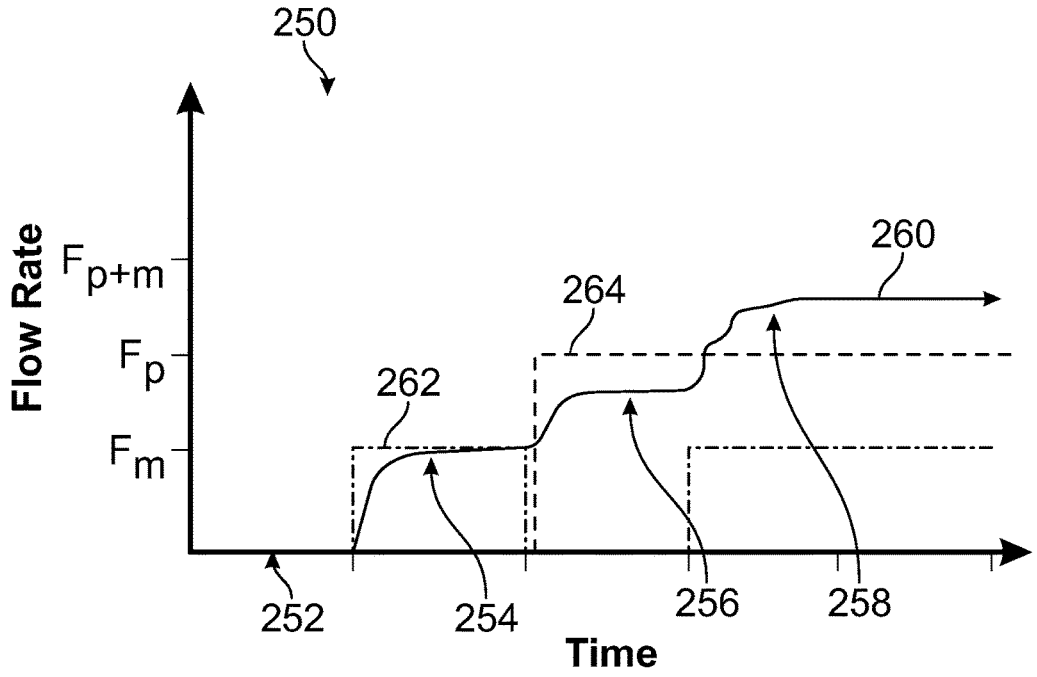
FIG. 7 is an example chart illustrating the flow rate of liquid onto the adiabatic pad of the cooling tower of FIG. 1 when liquid is dispensed via a makeup valve, a recirculation pump, or both.

How the liquid distribution system 106 is distributing liquid may indicate the flow rate of the liquid from the liquid distribution system 106 onto the adiabatic pads 108. With respect to FIG. 7, an example graph 250 indicates the flow rate of liquid onto the adiabatic pad 108 based on how the liquid distribution system 106 is distributing liquid. The line 262 represents the flow rate from the makeup valve 116 as the makeup valve 116 is turned on and off. Line 264 represents the flow rate from the pump 122 as the pump 122 is turned on. The line 260 represents the flow rate of liquid from the troughs 118 onto the adiabatic pads 108 over time as the makeup valve 116 and pump 122 are turned on. At segment 252 of the line 260, the cooling tower 100 is in the dry mode where the liquid distribution system 106 is not distributing liquid onto the adiabatic pad 108. At segment 254 of the line 260, the cooling tower 100 is in the wet mode and the liquid distribution system 106 is distributing liquid onto the adiabatic pad 108 via only the makeup valve 116 providing liquid to the troughs 118. The flow rate of the liquid onto the pad 108 is a flow rate $F_m$.

At segment 256, the liquid distribution system 106 shuts off the makeup valve 116 and is distributing liquid onto the adiabatic pads 108 by operating only the pump 122 to provide liquid to the troughs 118. The pump 122 pumps liquid from the sump 120 into the troughs 118, and the openings of the troughs 118 permit liquid to drip out of the trough 118 and onto the adiabatic pads 108. The flow rate of the liquid onto the adiabatic pads 108 is flow rate $F_p$ which is greater than flow rate $F_m$. The pump 122 may provide liquid into the troughs 118 at a higher rate than the makeup valve 116 provides liquid into the troughs 118. With more liquid in the trough 118, the head of liquid in the troughs 118 is increased (e.g., due to the higher liquid level) which forces the liquid to flow out of the trough 118 and onto the adiabatic pad 108 at a faster flow rate. At segment 258, the makeup valve 116 is opened while the pump 122 operates. The flow rate onto the pad is $F_{p+m}$ which is greater than $F_p$. With both the makeup valve 116 and pump 122 dispensing liquid into the troughs 118, the height of the liquid in the troughs 118 is even higher than when only the pump 122 is operating, increasing the head of the liquid at the outlets of the trough 118 and forcing the liquid onto the pad 108 at a higher flow rate, $F_{p+m}$.

Based on the determination 210 of how the liquid distribution system 106 is distributing liquid onto the adiabatic pad 108, the controller 126 determines 212, 214, 216 and sets an upper limit on the operation of the fan assembly 102, such as the maximum operational speed of the fan assembly 102. The maximum operational speed of the fan assembly 102 may be a percentage of the maximum speed the fan assembly 102 is able to be operated at. For example, where the fan assembly 102 is capable of operating up to 2000 RPM, and the maximum operational speed of the fan assembly is set at 50%, the controller 126 does not operate the fan assembly 102 at more than 1000 RPM regardless of the cooling requested by the HVAC system controller.

The controller 126 may determine 212, 214, 216 the maximum operational speed of the fan assembly 102 by referencing a data source (e.g., data structure, lookup table, graph, and/or equation) that indicates what the maximum operational speed of the fan assembly 102 should be based on the time since the cooling tower 100 entered the wet mode and how the liquid distribution system 106 is distributing liquid. For example, the data source may be indicative of data collected from experimental tests for the cooling tower 100 that indicate what the maximum operational speed 102 of the fan assembly 102 is able to be without causing unacceptable drift from the adiabatic pads 108 based on the time since the liquid distribution system 106 began dispensing liquid and how the liquid distribution system 106 is distributing the liquid (e.g., makeup valve, pump, or both). The maximum operational speed data may differ based on the model and internal configuration of the cooling tower 100.

Figure 8:
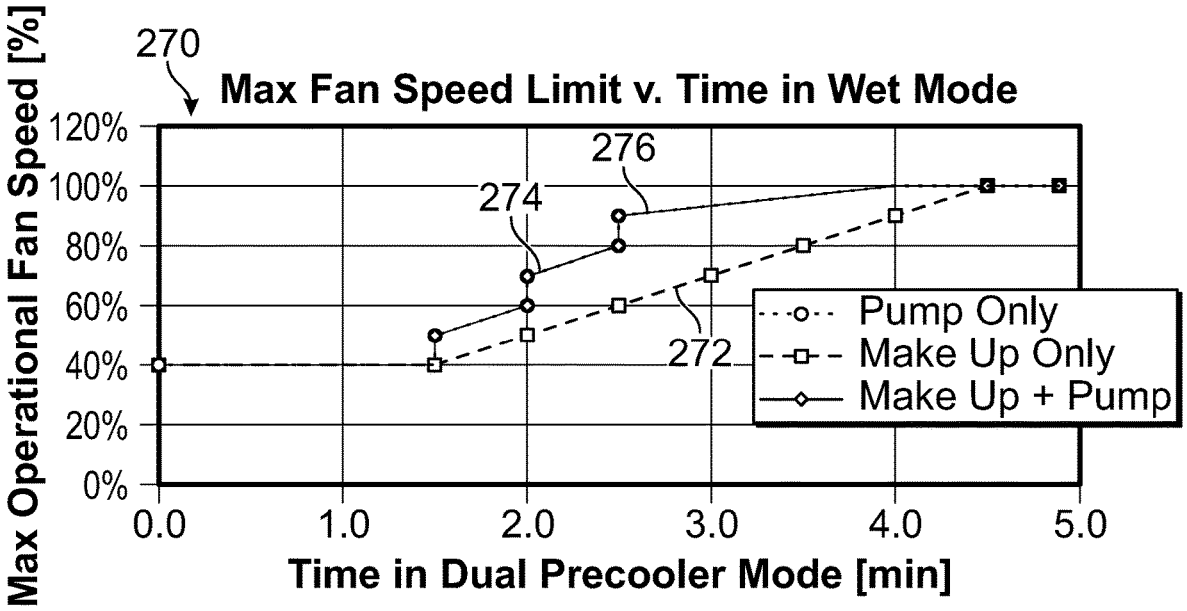
FIG. 8 is an example graph illustrating fan speed limits charted against the time since the cooling tower transitioned to a wet mode of operation.

With respect to FIG. 8, an example graph 270 is provided that may be used by the controller 126 to determine the maximum operational speed of the fan assembly 102. Where the controller 126 determines the liquid distribution system 106 is distributing liquid via the makeup valve 116 only, the controller 126 refers to line 272 and determines 212 the maximum operational speed of the fan assembly 102 based on the time that has passed since the cooling tower 100 entered the wet mode, as stored in the timer. For example, where the timer is two minutes, the controller 126 may set the maximum operational speed of the fan assembly 102 at 50%. As another example, where the timer is four minutes, the controller 126 may set the maximum operational speed of the fan assembly 102 at 90%.

Where the controller 126 determines the liquid distribution system 106 is distributing liquid via the pump 122 only, the controller 126 refers to the line 274 and determines 214 the maximum operational speed of the fan assembly 102 based on the time that has passed since the cooling tower 100 entered the wet mode, as stored in the timer. For example, where the timer is two minutes, the controller 126 may set the maximum operational speed of the fan assembly 102 at 70%. As another example, where the timer is four minutes, the controller 126 may set the maximum operational speed of the fan assembly 102 at 100%.

Where the controller 126 determines the liquid distribution system 106 is distributing liquid via both the makeup valve 116 and the pump 122, the controller 126 refers to line 276 and determines 216 the maximum operational speed of the fan assembly 102 based on the time that has passed since the cooling tower 100 entered the wet mode, as stored in the timer. In this example, the line 276 is similar to the line 274. This may be due in part to a maximum absorption rate of the adiabatic pad 108 limiting how quickly the pad 108 is able to be soaked. As discussed herein, the amount of liquid absorbed into the pad 108—or how soaked the pad 108 is—may be indicative of the maximum speed at which the fan assembly 102 can be operated to limit drift. While in this example the line 276 is the similar to the line 274, in other examples and applications the lines 274, 276 may be different from one another such that a different maximum operational speed of the fan assembly 102 may be selected based on whether the pump or both the makeup valve and pump are distributing liquid.

Upon determining the maximum operational speed of the fan assembly 102, the controller 126 may determine 218 whether the maximum operational speed of the fan assembly 102 is at 100% such that the fan speed is no longer limited. If not, the controller 126 returns back to step 208, increments the timer and repeats steps 210-218 as described above. If the maximum operational speed of the fan assembly 102 is 100%, the transition phase is complete and the process ends 220.

Figure 9:
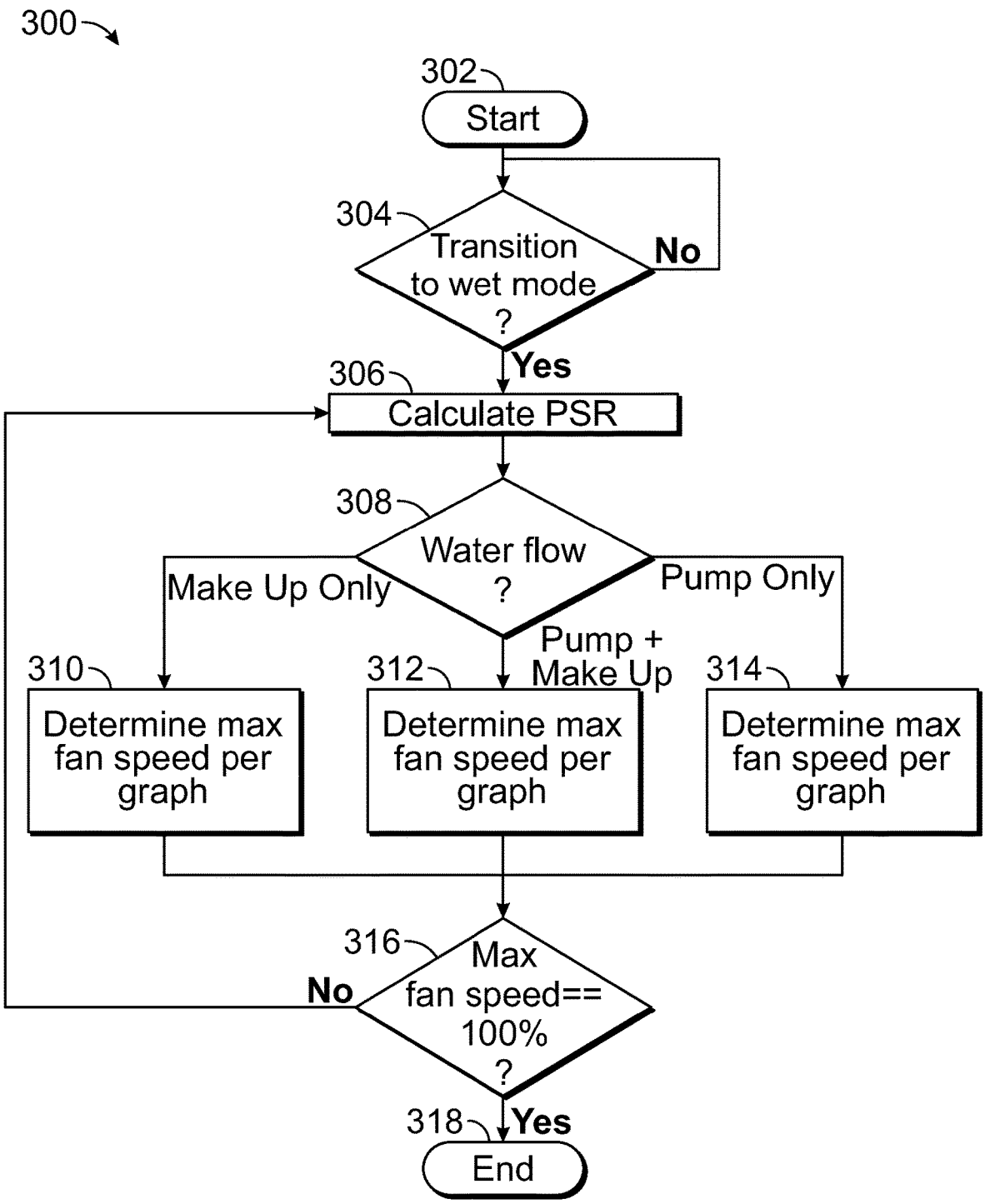
FIG. 9 is a flow chart of another method of operating the cooling tower of FIG. 1 to transition to the wet mode.

FIG. 9 shows an example method 300 of operating the cooling tower 100 to inhibit drift from the adiabatic pads 108 based on the amount of liquid determined to be absorbed within the adiabatic pads 108. The controller 126 begins 302 operation of the cooling tower 100. The controller 126 determines 304 whether to transition to the wet mode as described above, for example, with regard to step 204 of method 200. Where the controller 126 determines to continue in the dry mode, the controller 126 returns to step 304 until the controller 126 determines 304 to transition to wet mode.

If the controller 126 determines 304 to transition to the wet mode, the controller 126 calculates a liquid saturation parameter, such as pad-soaked-ratio (PSR), indicative of the liquid saturation level of the adiabatic pad 108. In one example, the controller 126 determines the PSR using data from one or more sensors 128 that indicate the dry bulb temperature and wet bulb temperature of the air that has passed through the adiabatic pad 108. The sensors 128 may include temperature and/or humidity sensors mounted within the plenum space 103 of the cooling tower 100 between the adiabatic pad 108 and the indirect heat exchanger 104 in the path of the airflow 109. As one example, the controller 126 may calculate the PSR by determining and comparing the dry bulb temperature of the air downstream of the adiabatic pad 108 to the wet bulb temperature. For instance, the PSR is the ratio of the wet bulb temperature to the dry bulb temperature. As the amount of liquid absorbed into the pad 108 increases, the relative humidity of the air downstream of the pad 108 increases thus lowering the dry bulb temperature toward the wet bulb temperature. When the dry bulb temperature equals the wet bulb temperature, the PSR is 100%.

As another example, the controller 126 may estimate the PSR by measuring and comparing the temperature and/or humidity of the air before and after the air passes through the adiabatic pad 108. As yet another example, where sensors 128 include liquid sensors embedded in the adiabatic pads 108, the controller 126 may estimate the PSR based on the position of the sensors detecting the liquid as the adiabatic pads 108 progressively saturating along the height of the adiabatic pads 108. More specifically, due to the troughs 118 distributing liquid onto the upper end portions 108B of the adiabatic pads 108, the adiabatic pads 108 may first become saturated at the upper end portions 108B, then intermediate portions 108C, and finally lower end portions 108A.

As an example, where a liquid sensor 128A is halfway between the upper and lower ends of the adiabatic pad 108, the controller 126 may determine the PSR is at least 50% when the liquid sensor detects liquid. Where a liquid sensor 128B is positioned at the lower end of the pad 128 (e.g., 9/10ths of the distance from the upper end to the lower end of the pad 108), the controller 126 may determine the PSR is at least 90% when the liquid sensor 128 detects liquid. In some forms, the pad 108 may have a series of sensors 128 disposed along the height of the pad 108 to monitor which portions of the pad 108 are soaked. As yet another example, the sensor 128 may include a weight sensor configured to measure the weight of the adiabatic pad 108. As the pad 108 absorbs more liquid, the measured weight of the pad 108 increases. The controller 126 may refer to a lookup table to determine the amount of liquid absorbed into the pad, and thus the PSR, based on the measured weight of the pad 108. The weight sensor 128 may be positioned beneath the adiabatic pads 108 to measure the weight of the adiabatic pads 108. As another example, the adiabatic pads 108 may hang from or be mounted to a frame or structural member of the cooling tower 100. A sensor, such as a strain gauge, may be used to measure the weight of the adiabatic pads 108, for example, based on a measured deflection of the structural member of the cooling tower 100.

The controller 126 may determine 308 how the liquid distribution system 106 is distributing liquid to the adiabatic pad 108 as described with regard to step 210 of method 200 above. For instance, the controller 126 may determine whether the liquid distribution system 106 is providing liquid via the makeup valve 116, the pump 122, or both.

Figure 10:
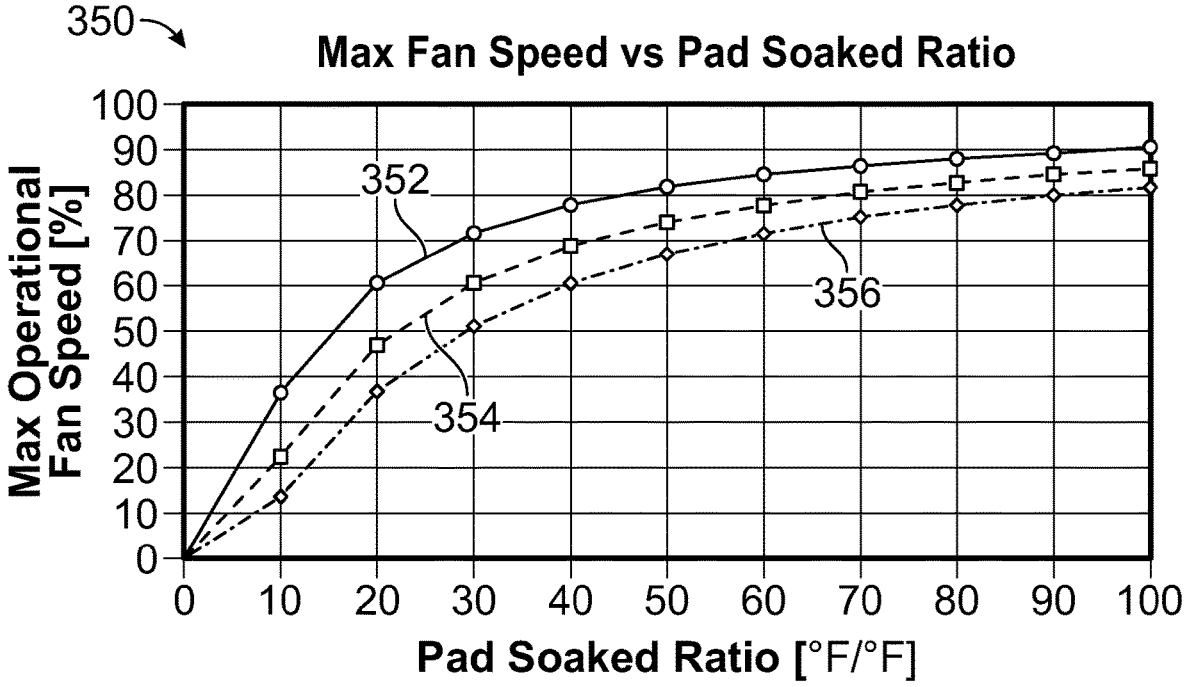
FIG. 10 is an example graph illustrating fan speed limits charted against a pad soaked ratio indicative of the liquid absorbed in the adiabatic pad.

Based on the determination 308 of how the liquid distribution system 106 is providing liquid to the adiabatic pad 108, the controller 126 determines 310, 312, 314 and sets an upper limit on the operation of the fan assembly 102, such as the maximum operational speed of the fan assembly 102. The controller 126 may determine 310, 312, 314 the maximum operational speed of the fan assembly 102 by referencing a data source (e.g., data structure, lookup table, graph, equation) that indicates what the maximum operational speed of the fan assembly 102 should be based on the PSR of the adiabatic pad 108. Data may be collected from experimental tests for the cooling tower 100 that indicate what the maximum operational speed 102 of the fan assembly 102 is able to be without causing unacceptable drift from the adiabatic pads 108 based on the PSR and how the liquid distribution system 106 is distributing the liquid (e.g., makeup valve, pump, or both). With respect to FIG. 10, an example graph 350 is provided that may be used by the controller 126 to determine the maximum operational speed of the fan assembly 102. Where the controller 126 determines the liquid distribution system 106 is distributing liquid via the makeup valve 116 only, the controller 126 refers to line 352 and determines 310 the maximum operational speed of the fan assembly 102 based on the PSR, as determined at step 306. For example, where the PSR is 20%, the controller 126 may set the maximum operational speed of the fan assembly 102 to about 60%. As another example, where the PSR is 60%, the controller 126 may set the maximum operational speed of the fan assembly 102 to about 85%.

Where the controller 126 determines the liquid distribution system 106 is distributing liquid via the pump 122 only, the controller 126 refers to line 354 and determines 314 the maximum operational speed of the fan assembly 102 based on the PSR of the adiabatic pad 108, as determined at step 306. For example, where the PSR is 20%, the controller 126 may set the maximum operational speed of the fan assembly 102 to about 50%. As another example, where the PSR is 60%, the controller 126 may set the maximum operational speed of the fan assembly 102 at about 80%.

Where the controller 126 determines the liquid distribution system 106 is distributing liquid via both the makeup valve 116 and the pump 122, the controller 126 refers to the line 356 and determines 312 the maximum operational speed of the fan assembly 102 based on the PSR of the adiabatic pads 108, determined at step 306. For example, where the PSR is 20%, the controller 126 may set the maximum operational speed of the fan assembly 102 to about 35%. As another example, where the PSR is 60%, the controller 126 may set the maximum operational speed of the fan assembly 102 at about 70%.

Upon determining the maximum operational speed of the fan assembly 102, the controller 126 may determine 316 whether the maximum operational speed of the fan assembly 102 is 100% such that the fan speed is no longer limited. If not, the controller 126 returns back to step 306 to recalculate the PSR of the pad 108 and repeats steps 308-316 as described above. If the maximum operational speed of the fan assembly 102 is 100%, the transition phase is complete and the process ends 318. The controller 126 may adjust the maximum operational speed of the fan assembly 102 based on the conditions of the cooling tower 100 as described above, for example, as the adiabatic pad 108 becomes dirty.

In some embodiments, the cooling tower 100 includes sensors 128 mounted within the cooling tower 100 to detect drift. When drift is detected by these sensors 128, the controller 126 may reduce the speed of the fan assembly 102 to adjust the flow of drift to an acceptable region of the cooling tower 100, for example, where the liquid particles fall in the fluid collection tray 123 and do not reach the coil 117. The sensors 128 may be, for example, water sensors that detect the presence of water particles or droplets. One or more water sensors may be mounted on the coil 117 to detect the presence of liquid on the on the coil 117. The water sensors may communicate data to the controller 126 for processing. The controller 126 may adjust the operation of the fan assembly 102 and/or liquid dispensing system 106 based on the water sensor data. In some forms, the controller 126 may generate an alarm when liquid is detected on the coil 117. The controller 126 may communicate, via the communication circuitry 134, the alarm to a remote computing device such as a server computer.

For example, an alarm may be generated where liquid is detected on the coil 117 when the controller 126 is operating the fan assembly 102 and/or liquid distribution system 106 in ranges where unacceptable drift should not be occurring. The alarm may call for maintenance or inspection and/or may log that liquid drift reached the coil 117 along with the operating parameters at which the undesired liquid drift occurred. Alternatively or additionally, one or more water sensors may be mounted on the fluid collection tray 123 to detect when liquid is falling onto the fluid collection tray 123. The water sensors may be mounted at a portion of the fluid collection tray 123 near the coil 117 to detect the presence of liquid particles drifting near the coil 117. In some forms, the controller 126 reduces the speed of the fan assemblies 102 and/or the flow rate of the liquid dispensed from the liquid dispensing system 106 upon detecting liquid on the coil 117 and/or tray 123 until liquid drift is no longer detected.

In some embodiments, the cooling tower 100 may include sensors 128 that detect the presence of liquid particles or droplets in the airflow from the adiabatic pad 108 toward the coil 117. For instance, the sensors 128 may include one or more laser sensors positioned within the cooling tower 100. For example, the laser sensors may include a laser beam generator and a detector mounted within the cooling tower 100. The laser beam generator may generate a laser beam that is detected by the detector. As liquid particles are stripped from the adiabatic pad 108 and carried toward the coil 117, the liquid particles may break the laser beam such that the laser beam is temporarily not detected at the detector. The laser sensor and/or controller 126 may count the number of breaks in the laser beam to quantify the drift in the plenums 103. As another example, the sensors 128 may include one or more radar sensors positioned within the cooling tower 100. The radar sensors may generate radio waves and detect reflections of the radio waves from the drift. As another example, the sensors 128 may include one or more cameras mounted within the cooling tower 100 and positioned to capture images of the plenum 103 downstream of the adiabatic pads 108. In some forms, the cameras may be configured to capture images at high speeds and strobe lighting may be used as the images are captured. A computing device, such as controller 126, may process the images to detect liquid droplets in the images and to determine the amount of drift. The controller 126 may adjust the operation of the cooling tower 100 based on the detected amount of drift to inhibit drift from reaching the indirect heat exchanger 104.

In some situations, the controller 126 may adjust the operation of the liquid dispensing system 106 to inhibit liquid drift instead of or in addition to controlling the speed of the fan assembly 102. For example, in some cooling towers 100, the fan assembly 102 is configured to operate in a failsafe mode (e.g., when the control signal to the fan is lost) where the fan assembly 102 runs at full speed or 100% of the maximum speed of the fan assembly 102 to ensure adequate cooling in the event the controller 126 has to provide its maximum cooling capacity. As another example, the speed of the fan assembly 102 is controlled by a device other than the controller 126 such that the controller 126 is unable to adjust the operational speed of the fan assembly 102. In such situations, where the controller 126 determines to operate the cooling tower 100 in the wet mode, the controller 126 may operate the liquid dispensing system 106 to slowly wet the adiabatic pad 108 to inhibit drift as the cooling tower 100 transitions to the wet mode. The controller 126 may reference a data source (e.g., data structure, lookup table, graph, and/or equation) that indicates what the maximum liquid distribution rate of the liquid distribution system 106 is able to be set to so that drift is limited or inhibited based on the speed the fan assembly 102 is operating at. For example, the maximum liquid dispensing rate may be determined experimentally by monitoring the amount of drift from the adiabatic pads 108 onto the indirect heat exchangers 104 at various fan speeds and flow rates of liquid onto the adiabatic pad 108. The controller 126 may receive data from one or more sensors 128 indicative of the PSR of the pad 108. The controller 126 may adjust the maximum liquid flow rate based on the PSR, for example, as the PSR increases the controller 126 may increase the maximum liquid flow rate of the liquid distribution system 106. As another example, the controller 126 may monitor the amount of time that since the liquid distribution system 106 began dispensing liquid onto the adiabatic pads 108 and adjust the maximum liquid flow rate of the liquid distribution system 106 over time. In some forms, the controller 126 receives data from water sensors detecting drift from the adiabatic pad 108 within the cooling tower 100 as described above and adjusts the maximum liquid distribution rate based on the amount of drift that is detected.

Figure 11:
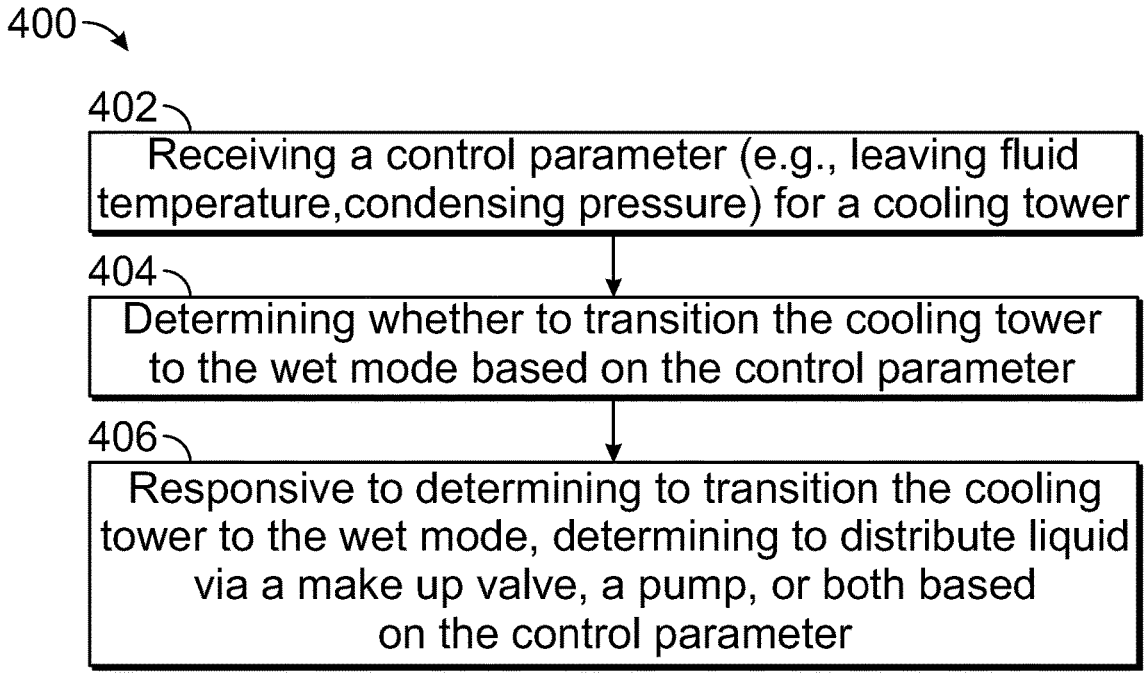
FIG. 11 is a flow chart of a method for transitioning the cooling tower of FIG. 1 to the wet mode.

With respect to FIG. 11, an example method 400 is provided for selecting the mode of operation of the liquid distribution system 106 of the cooling tower 100 to meet a cooling demand. The controller 126 of the cooling tower 100 receives 402 a control parameter for the cooling tower 100. The controller 126 may receive the control parameter from a remote device, such as an HVAC system controller of a building or other computing device coordinating operation of a heat exchange system including the cooling tower 100. The control parameter may be a requested temperature of the fluid leaving the fluid outlet 107 of the indirect heat exchanger 104 so that the fluid is at the correct temperature to be provided to a chiller of the building. As another example, the control parameter may be a pressure of the fluid leaving the fluid outlet 107 of the indirect heat exchanger. The controller 126 determines 404 whether the cooling tower 100 is able to implement the control parameter in the dry mode of operation or whether to transition the cooling tower 100 to the wet mode of operation. The controller 126 may determine whether to transition to the wet mode as described above, e.g., with regard to step 204 of FIG. 6.

Upon determining to transition to the wet mode, the controller may determine 406 how to distribute liquid onto the adiabatic pad 108 via the liquid distribution system 106, for example, via the makeup valve 116, the pump 122 in the sump 120, or both. As described above with respect to FIG. 7, the flow rate of liquid from the liquid distribution system 106 onto the adiabatic pad 108 changes based on whether the liquid distribution system 106 is distributing liquid via the makeup valve 116, pump 122, or both. As shown in FIG. 8, the fan assembly 102 may be operated at high speeds more quickly after the start of the wet mode if the liquid distribution system 106 is distributing fluid via the pump 122 or both the pump 122 and the makeup valve 116 than if the liquid distribution system 106 were only distributing fluid via the makeup valve 116. Operating the fan assembly 102 at higher speeds may be desired to increase the amount of cooling provided by the cooling tower 100. For example, where the control parameter received by the controller 126 sets the requested temperature of the fluid at the fluid outlet 107 significantly below the temperature of the fluid currently leaving the fluid outlet 107, the controller 126 may determine that to transition to the wet mode as quickly as possible and/or to provide as great an amount of cooling as quickly as possible to satisfy the control parameter. The controller 126 may determine, based on the control parameter, to distribute fluid via the pump 122 or both the pump 122 and makeup valve 116 to provide increased cooling more quickly. Or, where the controller 126 determines that the control parameter is able to be met at lower fan speeds and/or that a slower transition to the wet mode is permissible given the control parameter, then the controller 126 may distribute liquid via the makeup valve 116 which may, for example, reduce the amount of energy consumed by the cooling tower 100.

Whether the controller 126 is able to distribute fluid via the makeup valve 116, the pump 122, or both may depend on the amount of liquid in the sump 120. As mentioned above, the cooling tower 100 may include one or more floats 119 or sensors within the sump 120 that monitor the amount of fluid in the basin 121. Where the fluid level in the basin 121 is detected to be below a low-level threshold, the controller 126 may determine to open the makeup valve 116 to distribute liquid and to inhibit operation of the pump 122. Where the fluid level in the basin 121 is detected to be above a high-level threshold, the controller 126 may determine to close or keep closed the makeup valve 116 and to run the pump 122 to distributed liquid. Where the fluid level is above the low-level threshold and below the high-level threshold, the controller 126 may determine to open the makeup valve 116 and/or to run the pump 122. The float 119 may include a low-level float for monitoring the liquid level below the low level threshold, a mid-level float for monitoring the liquid level between the low and high level thresholds, and a high level float for monitoring the liquid level above the high level threshold. The controller 126 may open the drain valve 124 when the liquid level exceeds a certain height.

Figure 12A:
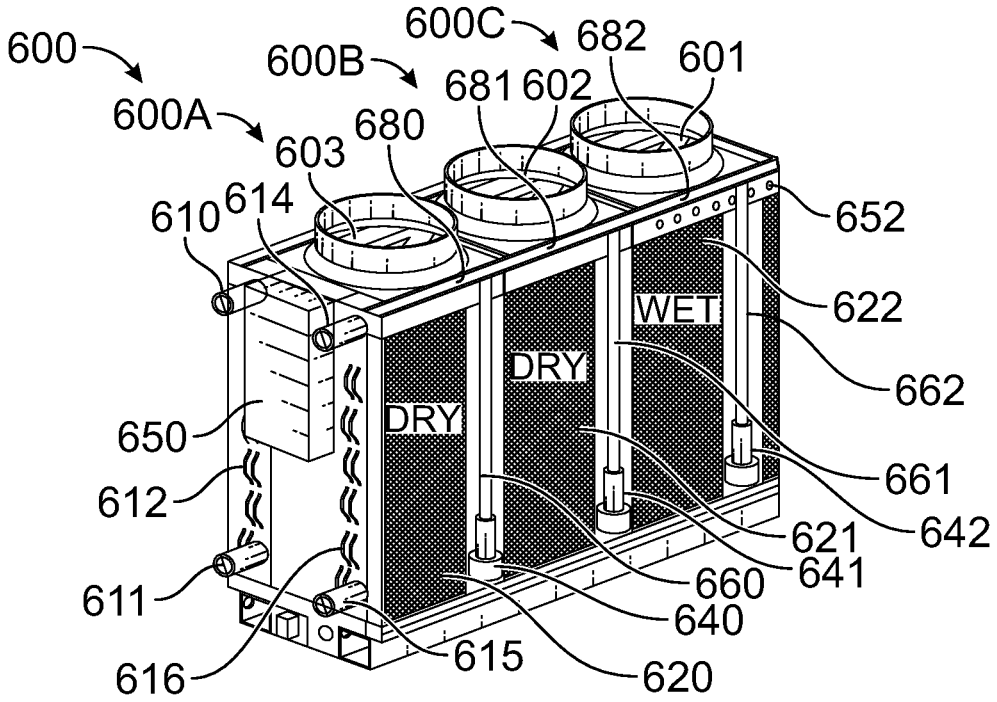
FIGS. 12A and 12B are perspective views of a heat exchanger system including multiple cooling towers.
Figure 12B:
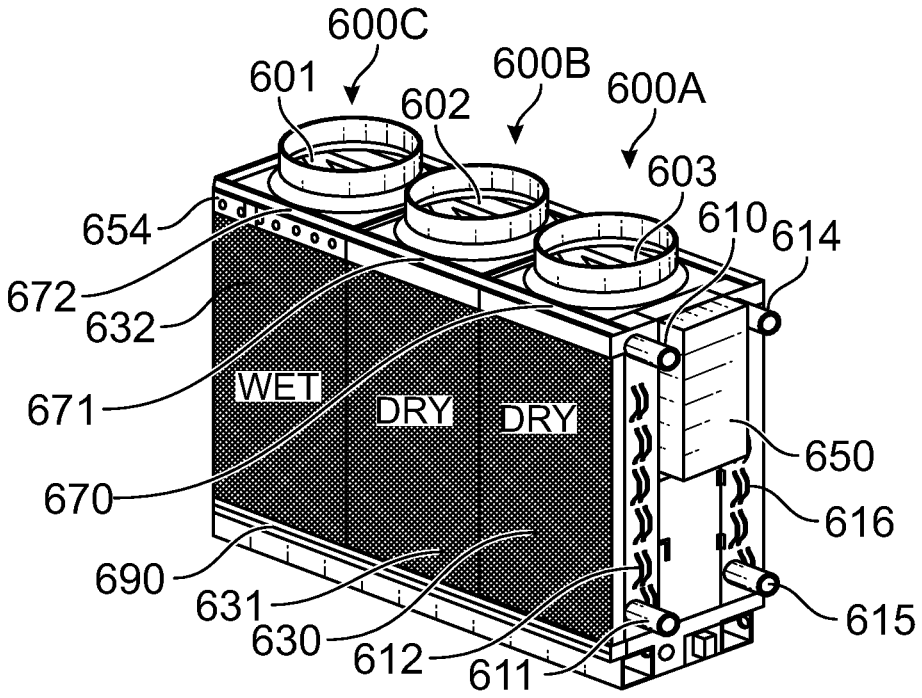

With respect to FIGS. 12A and 12B, a heat exchanger system, such as a cooling tower system 600, is provided having multiple heat exchangers such as cooling towers 600A-C. The cooling towers 600A-C are similar to the cooling towers 100 described above and may use adiabatic pads to pre-cool air entering indirect heat exchanges of the cooling towers 600A-C. The heat exchanger system 600 is shown with three fan assemblies 601, 602 and 603 which induce air to flow through right side adiabatic pads 620, 621 and 622 and also through left side adiabatic pads 630, 631 and 632. After air travels through the adiabatic pads, the air travels through indirect heat exchanger coils of the cooling towers 600A-C(see e.g., reference numerals 612, 616) then out through the fan assemblies 601, 602 and 603. Evaporative liquid, such as water, is pumped from the sump 690 through conduits 660, 661 and 662 and then to right side liquid distribution system 680, 681 and 682 and left side liquid distribution system 670, 671 and 672 respectively. The liquid distribution systems 680, 681, 682, 670, 671, 672 distribute evaporative liquid 652 and 654 onto the adiabatic pads 630, 631, 632, 620, 621, 622 when pumps 640, 641 and 642 are operating. Other embodiments use solenoid valves instead of pumps to deliver liquid 652 and 654 to the top of the adiabatic pads. The heat exchanger system 600 includes a controller 650 that is configured to independently control pumps 640, 641 and 642 and also independently control the fan assemblies 601, 602, 603. Fluid to be cooled or condensed enters right side indirect heat exchangers through inlet 614 and exits through exit connection 615 while fluid to be cooled or condensed in the left indirect heat exchangers enters through connection 610 and exits through outlet 611.

The cooling tower system 600 is arranged to operate in a hybrid mode with one or more cooling towers 600A-C in the wet mode and the remaining cooling tower(s) 600A-C in the dry mode. Operating in the hybrid mode may conserve evaporative liquid where controller 650 has determined that operating all the adiabatic pads of the cooling towers 600A-C in the dry mode is not sufficient to meet the heat exchanging demands but that operating all the adiabatic pads is not needed. For example, controller 650 may turn on pump 642 which wets right adiabatic pad 622 and left adiabatic pad 632 and does not energize pumps 640 and 641, which keeps adiabatic pads 620, 621, 630 and 631 dry.

Figure 13:
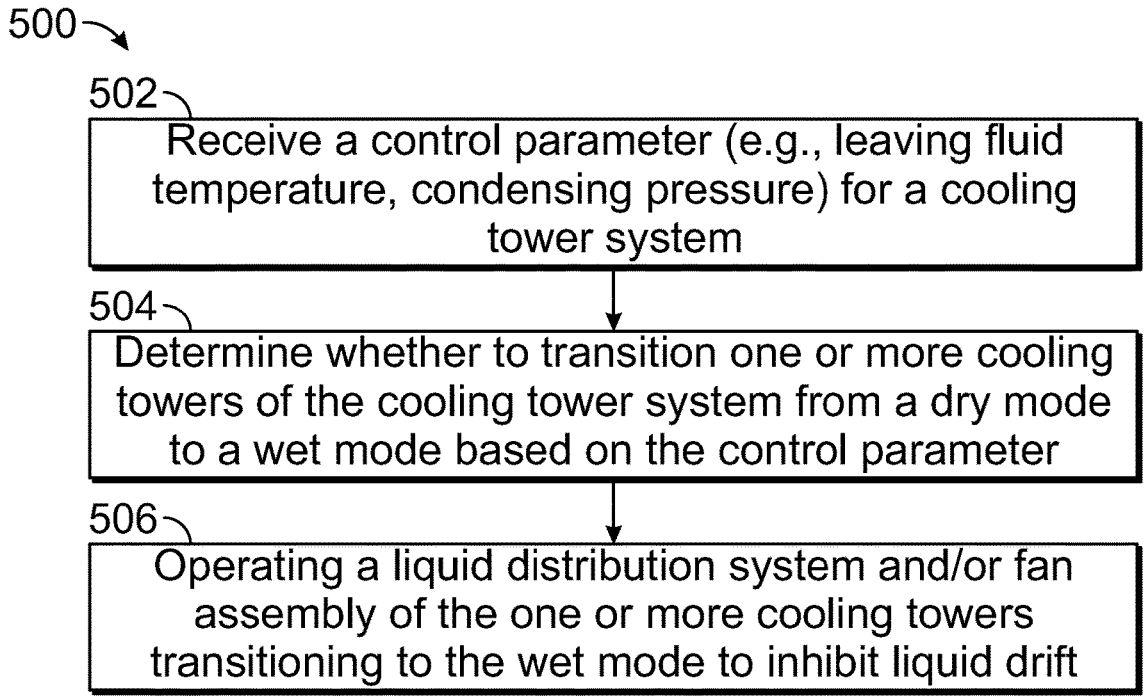
FIG. 13 is a flow chart of an example method of operating the heat exchanger system of FIG. 12.

With respect to FIG. 13, an example method 500 is provided for operating the cooling tower system 600. The controller 650 may receive 502 a control parameter (e.g., a cooling demand), for example, requesting the fluid flowing through the indirect heat exchangers of the cooling towers 600A-C be cooled by the cooling tower system 600 to a set temperature or condensed to a set pressure as described above. The controller 650 may determine 504 whether to change the mode of operation of one or more of the cooling towers 600A-C from the dry mode to the wet mode to meet the control parameter. The controller 650 may be configured to determine whether the cooling tower system 600 is able meet the control parameter by operating all of the cooling towers 600A-C in the dry mode. Upon determining the control parameter is not able to be met operating all cooling towers 600A-C in the dry mode, the controller 650 may determine to transition some or all of the cooling towers 600A-C to the wet mode to sufficiently implement the control parameter and meet a cooling demand. For the cooling towers 600A-C the controller 650 transitions to the wet mode, the controller 650 operates 506 the respective liquid distribution system(s) and/or fan(s) to inhibit liquid drift from the adiabatic pads to the indirect heat exchangers as described above. For instance, the controller 650 may set a maximum operational speed for the fan assemblies and/or a maximum liquid distribution rate for the liquid distribution system to inhibit the airflow generated by the fan from carrying unacceptable amounts of drift toward the indirect heat exchanger. As described above, the controller 650 may adjust, such as increase, the maximum operational speed of the fan and/or liquid distribution rate of the liquid distribution system with the passage of time and/or based on the PSR of the adiabatic pads.

Uses of singular terms such as "a," "an," are intended to cover both the singular and the plural, unless otherwise indicated herein or clearly contradicted by context. The terms "comprising," "having," "including," and "containing" are to be construed as open-ended terms. It is intended that the phrase "at least one of" as used herein be interpreted in the disjunctive sense. For example, the phrase "at least one of A and B" is intended to encompass A, B, or both A and B.

While there have been illustrated and described particular embodiments of the present invention, it will be appreciated that numerous changes and modifications will occur to those skilled in the art, and it is intended for the present invention to cover all those changes and modifications which fall within the scope of the appended claims.

What is claimed is:

1. A heat exchange apparatus comprising:

a heat exchanger configured to receive a fluid;

a liquid absorbent material upstream of the heat exchanger;

a liquid distribution system configured to distribute liquid onto the liquid absorbent material, the liquid distribution system comprising at least one of a pump and a valve;

a sump to collect liquid from the liquid absorbent material;

an airflow generator operable to cause air to flow through the liquid absorbent material and toward the heat exchanger;

a controller operably connected to the liquid distribution system and the airflow generator, the controller having a dry mode and a wet mode:

wherein, in the dry mode, the controller inhibits the liquid distribution system from distributing liquid onto the liquid absorbent material;

wherein, in the wet mode, the controller causes the liquid distribution system to distribute liquid onto the liquid absorbent material;

the controller configured to determine to switch from the dry mode to the wet mode based at least in part upon a setpoint temperature for the fluid;

wherein, in response to determining to switch from the dry mode to the wet mode, the controller is configured to:

determine a limit for an operating parameter of at least one of the liquid distribution system and the airflow generator during operation in the wet mode;

cause the liquid distribution system to distribute liquid onto the liquid absorbent material including operating the at least one of the liquid distribution system and the airflow generator based at least in part upon the limit for the operating parameter for a transition time period starting when the controller determines to switch from the dry mode to the wet mode to inhibit drift of liquid from the liquid absorbent material toward the heat exchanger as the liquid saturates the liquid absorbent material at a beginning of the wet mode; and upon expiration of the transition time period that started when the controller determines to switch from the dry mode to the wet mode, operate the at least one of the liquid distribution system and the airflow generator based at least in part upon the operating parameter to permit the heat exchange apparatus to operate at full capacity once the liquid has saturated the liquid absorbent material.

2. The heat exchange apparatus of claim 1 wherein the airflow generator comprises a fan assembly;

wherein to determine the limit for the operating parameter of the at least one of the liquid distribution system and the airflow generator comprises to determine the limit for the operating parameter of the airflow generator; and wherein to determine the limit for the operating parameter of the airflow generator comprises to set a maximum operational speed of the fan assembly.

3. The heat exchange apparatus of claim 2 wherein the controller adjusts the maximum operational speed of the fan assembly as an amount of liquid within the liquid absorbent material changes.

4. The heat exchange apparatus of claim 2 wherein the at least one of a pump and a valve of the liquid distribution system includes a liquid supply valve and a recirculation pump, wherein setting the maximum operational speed of the fan assembly is based at least in part on whether the liquid distribution system is distributing liquid via the liquid supply valve, the recirculation pump, or both.

5. The heat exchange apparatus of claim 1 wherein to determine the limit for the operating parameter of the at least one of the liquid distribution system and the airflow generator comprises to determine the limit for the operating parameter of the liquid distribution system; and wherein to determine the limit for the operating parameter of the liquid distribution system comprises to set a maximum fluid distribution rate of the liquid distribution system.

6. The heat exchange apparatus of claim 5 wherein the airflow generator comprises a fan assembly, wherein the controller is configured to adjust the maximum fluid distribution rate of the liquid distribution system based at least in part upon a speed of the fan assembly.

7. The heat exchange apparatus of claim 1 wherein to determine the limit for the operating parameter of the at least one of the liquid distribution system and the airflow generator comprises the controller monitoring a parameter of the heat exchange apparatus and to adjust the limit for the operating parameter of the at least one of the liquid distribution system and the airflow generator based at least in part on the parameter.

8. The heat exchange apparatus of claim 7 wherein to determine the limit for the operating parameter of the at least one of the liquid distribution system and the airflow generator comprises to determine the limit for the operating parameter of the liquid distribution system; and wherein the parameter includes a time the liquid distribution system has been distributing liquid onto the liquid absorbent material.

9. The heat exchange apparatus of claim 8 wherein the parameter includes an estimated saturation level of the liquid absorbent material.

10. The heat exchange apparatus of claim 8 further comprising at least one sensor operably connected to the controller, the controller configured to use data from the at least one sensor to determine a measurement of drift from the liquid absorbent material;

wherein the parameter includes the measurement of drift from the liquid absorbent material.

11. The heat exchange apparatus of claim 1 further comprising at least one sensor operably connected to the controller, the controller configured to use data from the at least one sensor to measure liquid in the liquid absorbent material.

12. The heat exchange apparatus of claim 11 wherein the at least one sensor includes a sensor positioned between the liquid absorbent material and the heat exchanger.

13. The heat exchange apparatus of claim 11 wherein the at least one sensor is embedded within the liquid absorbent material.

14. The heat exchange apparatus of claim 11 wherein the at least one sensor includes at least one of:

a temperature sensor;

a humidity sensor;

a water sensor; and a weight sensor.

15. The heat exchange apparatus of claim 1 further comprising a water sensor operably connected to the controller, the controller configured to determine a measurement of drift of liquid from the liquid absorbent material based at least in part upon data received from the water sensor and to determine the limit for the operating parameter of the at least one of the liquid distribution system and the airflow generator to inhibit drift based at least in part on the measurement of drift.

16. The heat exchange apparatus of claim 1 wherein the heat exchanger comprises a coil;

wherein the coil of the heat exchanger is oriented to extend obliquely to the liquid absorbent material such that an upper portion of the coil is closer to the liquid absorbent material than a lower portion of the coil; and a fluid collector intermediate the lower portion of the coil and the liquid absorbent material to collect liquid drawn from the liquid absorbent material by the flow of air.

17. The heat exchange apparatus of claim 1 wherein the heat exchanger comprises an indirect heat exchanger having an uncoated metal tube.

18. A controller for operating a heat exchange apparatus having a heat exchanger to receive a fluid, an airflow generator, a liquid distribution system comprising at least one of a pump and a valve, and a liquid absorbent material, the controller comprising:

a memory storing instructions for operating the heat exchange apparatus;

communication circuitry configured to communicate control signals to the heat exchange apparatus to operate the heat exchange apparatus;

a processor operably connected to the memory and the communication circuitry, the processor configured to:

determine, based at least in part upon a setpoint temperature for the fluid, to change the mode of operation of the heat exchange apparatus from a dry mode wherein the liquid distribution system is inhibited from distributing liquid onto the liquid absorbent material to a wet mode wherein the liquid distribution system distributes liquid onto the liquid absorbent material; and in response to the determination to change the mode of operation from the dry mode to the wet mode:

determine a limit for an operating parameter of at least one of the liquid distribution system and the airflow generator during operation in the wet mode;

cause the liquid distribution system to distribute liquid onto the liquid absorbent material including operating the heat exchange apparatus based at least in part upon the limit for the operating parameter for a transition time period starting when the controller determines to change from the dry mode to the wet mode to inhibit drift of liquid from the liquid absorbent material toward the heat exchanger as the liquid saturates the liquid absorbent material at a beginning of the wet mode; and upon expiration of the transition time period that started when the controller determines to switch from the dry mode to the wet mode, operate the heat exchange apparatus based at least in part upon the operating parameter to permit the heat exchange apparatus to operate at full capacity once the liquid has saturated the liquid absorbent material.

19. The controller of claim 18 wherein the airflow generator comprises a fan assembly;

wherein to determine the limit for the operating parameter of the at least one of the liquid distribution system and the airflow generator comprises to determine the limit for the operating parameter of the airflow generator; and wherein to determine the limit for the operating parameter of the airflow generator comprises to set a maximum operational speed of the fan assembly.

20. The controller of claim 19 wherein the controller is configured to:

determine a measurement of liquid absorbed by the liquid absorbent material using at least one sensor; and adjust the maximum operational speed of the fan assembly as the measurement of liquid absorbed by the liquid absorbent material increases.

21. The controller of claim 19 wherein the at least one of a pump and a valve of the liquid distribution system includes a liquid supply valve and a recirculation pump to distribute liquid onto the liquid absorbent material, wherein setting the maximum operational speed of the fan assembly is based at least in part upon whether the liquid distribution system is distributing liquid via the liquid supply valve, the recirculation pump, or both.

22. The controller of claim 18 wherein to determine the limit for the operating parameter of the at least one of the liquid distribution system and the airflow generator comprises to determine the limit for the operating parameter of the liquid distribution system; and wherein to determine the limit for the operating parameter of the liquid distribution system comprises to set a maximum fluid distribution rate of the liquid distribution system.

23. The controller of claim 22 wherein the controller is configured to adjust the maximum fluid distribution rate of the liquid distribution system based on a speed of a fan assembly of the airflow generator.

24. The controller of claim 18 wherein to determine the limit for the operating parameter of the at least one of the liquid distribution system and the airflow generator comprises the processor monitoring a condition of the heat exchange apparatus and to adjust the limit for the operating parameter of the at least one of the liquid distribution system and the airflow generator based at least in part on the condition.

25. The controller of claim 24 wherein the condition includes at least one of:

a time the liquid distribution system has been distributing liquid onto the liquid absorbent material;

an estimated of liquid absorbed by the liquid absorbent material; and a measurement of drift from the liquid absorbent material.

26. The controller of claim 24 wherein to adjust the limit for the operating parameter includes to adjust the limit as the condition changes.

27. The controller of claim 24 wherein the processor is configured to monitor the condition by receiving data from at least one sensor of the heat exchange apparatus and to measure liquid in the liquid absorbent material based at least in part on the data.

28. The controller of claim 27 wherein the processor is configured to measure liquid in the liquid absorbent material at least in part by determining a dry bulb temperature and wet bulb temperature of air that has passed through the liquid absorbent material based on data from the at least one sensor and comparing the dry bulb temperature and the wet bulb temperature.

29. The controller of claim 27 wherein the at least one sensor includes at least one liquid sensor embedded within the liquid absorbent material, wherein the processor is configured to measure liquid in the liquid absorbent material based at least in part upon the data of the liquid sensor indicating the presence of liquid at the at least one liquid sensor.

30. The controller of claim 18 wherein the processor is operatively connected to at least one sensor and configured to monitor drift in the heat exchange apparatus based at least in part based upon sensor data of the at least one sensor received at the processor indicating the presence of liquid in air flowing between the liquid absorbent material and the heat exchanger.

31. The controller of claim 30 wherein the sensor data indicates the presence of liquid on at least one of the heat exchanger and a fluid collection basin of the heat exchange apparatus.

32. The controller of claim 18 wherein the heat exchange apparatus comprises a first heat exchange apparatus and a second heat exchange apparatus;

wherein the processor is further configured to:

determine to change the second heat exchanger apparatus from the dry mode to the wet mode while operating the first heat exchange apparatus in the dry mode;

wherein to determine the limit for the operating parameter includes determining a second heat exchange apparatus limit of at least one of the liquid distribution system and the airflow generator of the second heat exchange apparatus; and wherein to operate the heat exchange apparatus based at least in part upon the limit for the operating parameter for a transition time period at a beginning of the wet mode comprises to operate the second heat exchange apparatus based at least in part upon the second heat exchange apparatus limit for the operating parameter for a transition time period at the beginning of the wet mode to inhibit drift of liquid within the second heat exchange apparatus upon changing the second heat exchange apparatus from the dry mode to the wet mode.

33. A method for operating a heat exchange apparatus having a heat exchanger to receive a fluid, an airflow generator, a liquid distribution system comprising at least one of a pump and a valve, and a liquid absorbent material, the method comprising:

at one or more processors:

determining, based at least in part upon a setpoint temperature for the fluid, to change a mode of operation of the heat exchange apparatus from a dry mode wherein a liquid distribution system of the heat exchange apparatus is inhibited from distributing liquid onto the liquid absorbent material of the heat exchange apparatus to a wet mode wherein the liquid distribution system distributes liquid onto the liquid absorbent material; and in response to determining to change the mode of operation from the dry mode to the wet mode:

determining a limit for an operating parameter of at least one of the liquid distribution system and the airflow generator during operation in the wet mode;

cause the liquid distribution system to distribute liquid onto the liquid absorbent material including operating the at least one of the liquid distribution system and the airflow generator of the heat exchange apparatus based at least in part upon the limit for the operating parameter for a transition time period starting when the one or more processors determine to switch from the dry mode to the wet mode to inhibit drift of liquid from the liquid absorbent material toward the heat exchanger as the liquid saturates the liquid absorbent material at a beginning of the wet mode; and upon expiration of the transition time period that started when the one or more processors determine to switch from the dry mode to the wet mode, operate the at least one of the liquid distribution system and the airflow generator based at least in part upon the operating parameter to permit the heat exchange apparatus to operate at full capacity once the liquid has saturated the liquid absorbent material.

34. The method of claim 33 wherein the airflow generator comprises a fan assembly;

wherein determining the limit for the operating parameter of the at least one of the liquid distribution system and the airflow generator comprises determining the limit for the operating parameter of the airflow generator; and wherein determining the limit for the operating parameter of the airflow generator comprises setting a maximum operational speed of the fan assembly.

35. The method of claim 34 further comprising determining a measurement of liquid absorbed by the liquid absorbent material using at least one sensor;

wherein determining the limit for the operating parameter of the airflow generator comprises adjusting the maximum operational speed of the fan assembly as the measurement of liquid absorbed by the liquid absorbent material increases.

36. The method of claim 34 wherein the at least one of a pump and a valve of the liquid distribution system includes a liquid supply valve and a recirculation pump, wherein setting the maximum operational speed of the fan assembly is based at least in part on whether the liquid distribution system is distributing liquid via the liquid supply valve, the recirculation pump, or both.

37. The method of claim 33 wherein determining the limit for the operating parameter of the at least one of the liquid distribution system and the airflow generator comprises determining the limit for the operating parameter of the liquid distribution system; and wherein determining the limit for the operating parameter of liquid distribution system comprises setting a maximum fluid distribution rate of the liquid distribution system.

38. The method of claim 37 further comprising determining a speed of a fan assembly of the airflow generator; and wherein determining the limit for the operating parameter of the liquid distribution system comprises adjusting the maximum fluid distribution rate of the liquid distribution system based on the speed of the fan assembly of the airflow generator.

39. The method of claim 33 wherein determining the limit for the operating parameter of the at least one of the liquid distribution system and the airflow generator comprises monitoring a condition of the heat exchange apparatus and adjusting the limit for the operating parameter of the at least one of the liquid distribution system and the airflow generator based at least in part on the condition.

40. The method of claim 39 wherein the condition includes at least one of:

a time the liquid distribution system has been distributing liquid onto the liquid absorbent material;

a measurement of liquid absorbed by the liquid absorbent material; and a measurement of drift from the liquid absorbent material.

41. The method of claim 39 wherein adjusting the limit for the operating parameter of the at least one of the liquid distribution system and the airflow generator includes adjusting the limit as the condition changes.

42. The method of claim 39 wherein monitoring the condition includes receiving data from at least one sensor of the heat exchange apparatus and determining liquid absorbed by the liquid absorbent material based at least in part on the data.

43. The method of claim 42 wherein determining the liquid absorbed by the liquid absorbent material includes determining a dry bulb temperature and wet bulb temperature of air that has passed through the liquid absorbent material based at least in part upon data of the at least one sensor and comparing the dry bulb temperature and the wet bulb temperature.

44. The method of claim 42 wherein the at least one sensor includes at least one liquid sensor embedded within the liquid absorbent material, wherein determining the liquid absorbed by the liquid absorbent material is based at least in part on the data of the liquid sensor indicating the presence of liquid at the at least one liquid sensor.

45. The method of claim 33 further comprising receiving sensor data from at least one sensor;

wherein determining the limit of the operating parameter of the at least one of the liquid distribution system and the airflow generator of the heat exchange apparatus includes monitoring drift within the heat exchange apparatus at least in part based on the sensor data indicating the presence of liquid in air flowing between the liquid absorbent material and the heat exchanger.

46. The method of claim 45 wherein the sensor data indicates the presence of liquid on at least one of the heat exchanger and a fluid collection basin of the heat exchange apparatus.

47. The method of claim 33 wherein the heat exchange apparatus comprises a first heat exchange apparatus and a second heat exchange apparatus;

wherein determining to change the mode of operation of the heat exchange apparatus comprises determining to change the second heat exchange apparatus from the dry mode to the wet mode while operating the first heat exchange apparatus in the dry mode;

wherein determining the limit for the operating parameter includes determining a second heat exchange apparatus limit of at least one of the liquid distribution system and the airflow generator of the second heat exchange apparatus; and wherein operating the at least one of the liquid distribution system and the airflow generator based at least in part upon the limit for the operating parameter for a transition time period at the beginning of the wet mode to inhibit drift comprises operating at least one of the liquid distribution system and the airflow generator of the second heat exchange apparatus based at least in part upon the second heat exchange apparatus limit for a transition time period at the beginning of the wet mode to inhibit drift of liquid in the second heat exchange apparatus upon changing the second heat exchange apparatus from the dry mode to the wet mode.

* * * * *